US006932757B2

(12) United States Patent
Beattey

(10) Patent No.: US 6,932,757 B2
(45) Date of Patent: Aug. 23, 2005

(54) CENTRIFUGE WITH A VARIABLE FREQUENCY DRIVE AND A SINGLE MOTOR AND CLUTCH MECHANISM

(76) Inventor: Jeffery N. Beattey, 8689 Admirals Woods Dr., Indianapolis, IN (US) 46236

( * ) Notice: Subject to any disclaimer, the term of this patent is extended or adjusted under 35 U.S.C. 154(b) by 0 days.

(21) Appl. No.: 10/868,323

(22) Filed: Jun. 15, 2004

(65) Prior Publication Data

US 2005/0003945 A1 Jan. 6, 2005

Related U.S. Application Data

(60) Division of application No. 10/244,332, filed on Sep. 16, 2002, now abandoned, which is a continuation of application No. 09/598,139, filed on Jun. 21, 2000, now Pat. No. 6,461,286, which is a division of application No. 09/318,585, filed on May 25, 1999, now Pat. No. 6,224,532, which is a continuation-in-part of application No. 09/090,043, filed on Jun. 3, 1998, now Pat. No. 6,478,724.

(51) Int. Cl.[7] ..... B04B 9/00; B04B 11/08
(52) U.S. Cl. ..... 494/55; 494/84
(58) Field of Search ..... 494/50–55, 58, 494/84; 210/272–377; 366/312, 313

(56) References Cited

U.S. PATENT DOCUMENTS

| | | | |
|---|---|---|---|
| 2,040,351 | A | 5/1936 | Williams |
| 2,056,888 | A | 10/1936 | Pecker |
| 2,113,160 | A | 4/1938 | Murphree et al. |
| 2,414,421 | A | 1/1947 | Small |
| 2,443,593 | A | 6/1948 | Birsch |
| 2,731,151 | A | 1/1956 | Hopper |
| 2,761,564 | A | 9/1956 | Tholl et al. |
| 2,906,466 | A | 9/1959 | Hopper |
| 2,925,180 | A | 2/1960 | Geiger |
| 3,188,677 | A | 6/1965 | Jamison, Jr. |
| 3,228,595 | A | 1/1966 | Sharples |
| 3,307,666 | A | 3/1967 | Miller et al. |
| 3,403,848 | A | 10/1968 | Windsor et al. |
| 3,687,360 | A | 8/1972 | Prew et al. |
| 3,741,465 | A | 6/1973 | Lincoln |
| 3,764,062 | A | 10/1973 | Brautigam |
| 3,771,290 | A | 11/1973 | Stethem |
| 3,773,352 | A | 11/1973 | Laven |

(Continued)

FOREIGN PATENT DOCUMENTS

| | | |
|---|---|---|
| CH | 604906 | 12/1977 |
| DE | 39 27 707 A1 | 3/1990 |
| GB | 2003757 | 3/1979 |
| JP | 59-066367 | 4/1984 |
| JP | 59-225761 | 12/1984 |

*Primary Examiner*—Charles E. Cooley
(74) *Attorney, Agent, or Firm*—Bose McKinney & Evans LLP

(57) ABSTRACT

An improved blade design and method for enhancing the efficiency of operation of a centrifuge is disclosed based on measuring a varying value of the load on the centrifuge as the flow of contaminated fluid is injected into the centrifuge. The centrifuge has a plurality of blades with radially overlapping edges to keep the fluid being centrifuged compartmentalized and thus quiet for maximum efficiency. Additionally, the scraping blade assembly has blades which are angled in the scraping direction to force the solids towards the exit of the centrifuge, whether that be at the bottom or the top. A programmable logic controller monitors the load on the drive motor and compares a baseline value of load after accelerating the rotor to speed to the value of load while the contaminated fluid is injected into the rotor. The varying second value of load, measured during injection of fluid into the assembly, is compared to the baseline value of load to determine flow rate of the fluid being injected into the rotor assembly or to ascertain whether any dysfunction is occurring and to take appropriate steps to correct malfunction.

20 Claims, 16 Drawing Sheets

U.S. PATENT DOCUMENTS 3,851,819 A 12/1974 Tadokoro
3,861,584 A 1/1975 Durey
3,862,714 A 1/1975 Boadway
3,914,956 A 10/1975 Knight, Jr.
3,937,317 A 2/1976 Fleury, Jr.
3,977,515 A 8/1976 Lewoczko
4,141,835 A 2/1979 Schael et al.
4,155,503 A 5/1979 Sears
4,223,829 A 9/1980 Bange
4,234,123 A 11/1980 Cory
4,369,915 A 1/1983 Oberg et al.
4,416,655 A 11/1983 Bennett
4,432,747 A 2/1984 Posse et al.
4,447,322 A 5/1984 Zajdlik
4,449,967 A 5/1984 Caldwell
4,522,620 A 6/1985 Leister
4,552,461 A 11/1985 Ott et al.
4,585,558 A 4/1986 Rubin
4,829,230 A 5/1989 Perry
4,916,920 A 4/1990 Weis et al.
4,978,331 A 12/1990 Luchetta et al.
4,990,130 A 2/1991 Prais
5,037,373 A 8/1991 Mozley
5,250,180 A 10/1993 Chang
5,356,367 A 10/1994 Carr
5,362,293 A 11/1994 Romanauskas
5,368,541 A 11/1994 Knelson
5,380,434 A 1/1995 Paschedag
5,403,260 A * 4/1995 Hensley
5,425,698 A 6/1995 Carr
5,429,581 A 7/1995 Michaud et al.
5,454,777 A 10/1995 Ziems et al.
5,466,385 A 11/1995 Rogers et al.
5,512,031 A 4/1996 Ziems et al.
5,529,566 A 6/1996 Weil
5,681,256 A 10/1997 Nagafuji
5,681,257 A 10/1997 Letourneur
5,709,643 A 1/1998 Borgstrom et al.
5,714,858 A 2/1998 Pieralisi
5,733,238 A 3/1998 Carr
5,743,840 A 4/1998 Carr
5,765,671 A 6/1998 Endo et al.
5,857,955 A 1/1999 Phillips et al.
5,879,279 A 3/1999 Berger et al.
5,919,123 A * 7/1999 Phillips
6,126,587 A 10/2000 Berger et al.
6,149,573 A 11/2000 Berger et al.
6,206,818 B1 3/2001 Deschamps
6,224,532 B1 5/2001 Beattey
6,248,054 B1 * 6/2001 Berger et al.
6,251,056 B1 * 6/2001 Berger et al.
6,350,224 B1 2/2002 Cordaro et al.
6,461,286 B1 10/2002 Beattey
6,478,724 B1 11/2002 Beattey
6,776,752 B2 * 8/2004 Carr

* cited by examiner

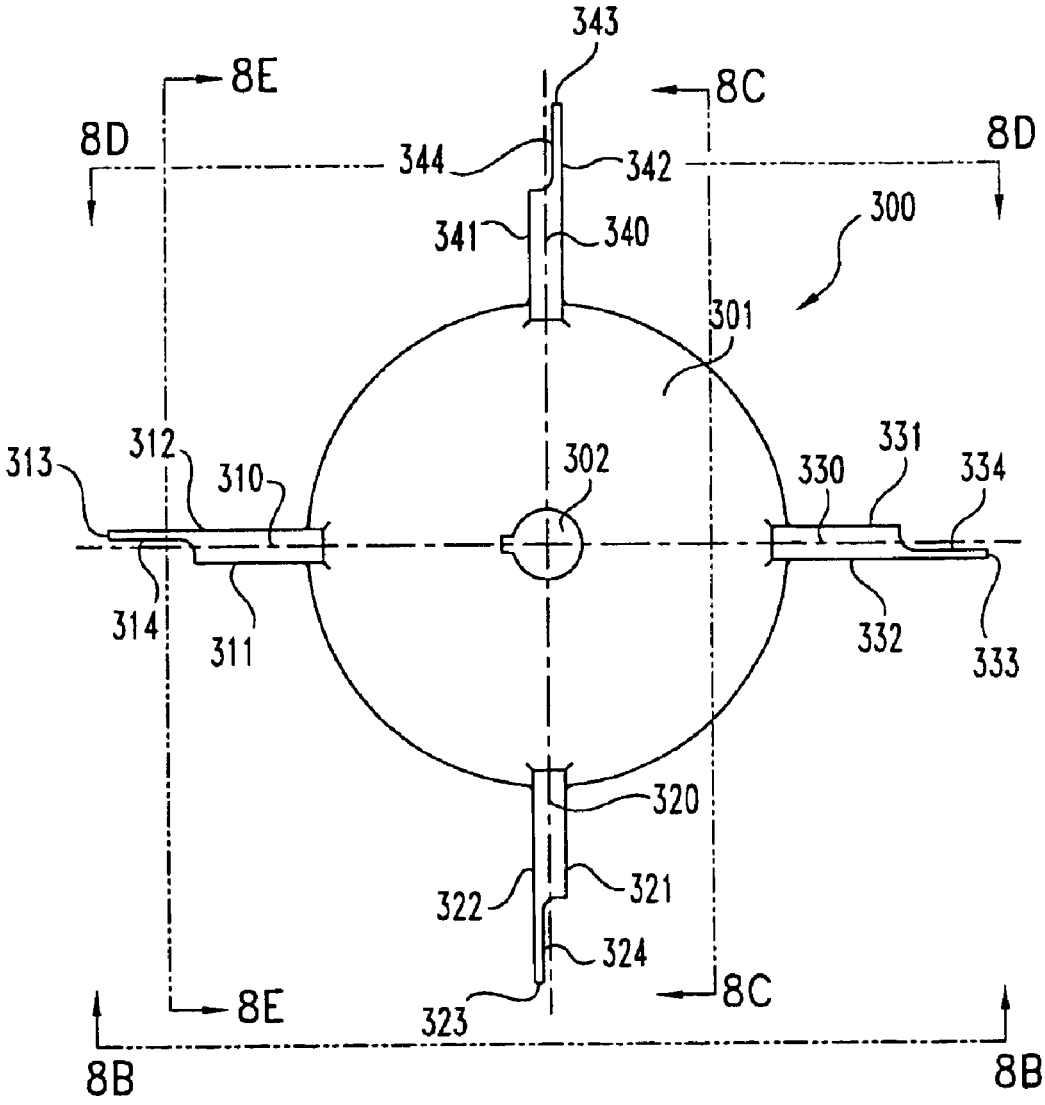
*Fig. 8A*
REPLACEMENT SHEET

CENTRIFUGE WITH A VARIABLE FREQUENCY DRIVE AND A SINGLE MOTOR AND CLUTCH MECHANISM

This application is a divisional of application Ser. No. 10/244,332, filed Sep. 16, 2002, now abandoned, which is a continuation of application Ser. No. 09/598,139, filed Jun. 21, 2000, now U.S. Pat. No. 6,461,286, which is a divisional of application Ser. No. 09/318,585 filed May 25, 1999, now U.S. Pat. No. 6,224,532, which is a continuation-in-part of application Ser. No. 09/090,043, filed Jun. 3, 1998, now U.S. Pat. No. 6,478,724.

BACKGROUND OF THE INVENTION

The present invention relates to a centrifugal separation device and method of separating solids in liquids. The liquid has solid particles in suspension. Suspended solids removal can be achieved in many ways. Solids can be settled out in a tank, filtered out using cartridges or indexing paper or a filter press. Settling is a slow process and other alternatives generate an immense labor cost or a waste stream that may be greater than the solids alone.

Use of a centrifugal separation device allows the extraction of the solid particles from the liquid. In a centrifugal separator, the separation of the solid from the liquid is commonly accomplished by pumping the contaminated liquid or coolant into a high speed rotating chamber or bowl. The centrifugal forces created by high speed rotation of the chamber cause the contaminated fluid to conform to the interior surface of the rotating chamber. The centrifugal energy causes the heavier solids to concentrate in a solid cake form for easy removal, reclamation, reuse or disposal. Since the chamber or bowl is rotating at a high speed, the solid material adheres to the side of the bowl while a cleansed coolant or liquid exits through an opening or openings commonly located at the bottom or top of the bowl. Centrifugal separation is preferable to the more traditional medium of filtration because filtration does not allow for removal of submicron particles without extensive and very expensive filtering. When such filtering is performed, the filter paper or cartridges become clogged quickly and must be disposed of. Additionally, these filtration devices often cannot pass high viscosity fluid.

With the advent of computer controls, the horizon of activities to which centrifugal separation may be applied, such as use as a waste separator, has been greatly expanded. For example, metal working coolants often become contaminated during grinding, wire drawing, machining, polishing, vibratory deburring or other metal working processes. Centrifugal separation allows fluid cleaning to increase coolant life and the solid discharge from centrifugation may have a marketable value or be disposable at minimal costs. The large spectrum of applications extends to contaminated fluids resulting from phosphate baths, dielectrics, glass grinding, EDM machining, water rinse baths, acid baths, all the way to food processing wherein oils can be contaminated by starches and other food products.

It is well known in the art that the efficiency of a centrifugal separator decreases when the scraper blades or stilling vanes do not rotate at the same speed as the bowl or chamber. It is desirable if the scraper blades inside the bowl rotate at the same speed as the bowl until such time as it is desired for them to scrape or plow the solids from the side of the bowl and expel them from the process chamber.

Current systems, as will be discussed in more detail later, use a frictional mechanism in an attempt to obtain equal rotational speeds between the blades and the bowl. This frictional mechanism does not provide the consistent synchronous blade and bowl rotation desired. In operation, a user will periodically start the system up and direct a strobe light into the centrifuge to check whether the bowl and blade are rotating at the same speed. Since the frictional mechanism does not provide a positive lock between the bowl and the blade there is no way of knowing whether the bowl and blade are continuing to rotate together during processing. Furthermore, the frictional clutch mechanism possesses a great many parts, which increases the amount of time that must be spent for maintenance purposes.

Additionally, current systems are prone to spray or mist the fluids exiting the rotating bowl, which can be hazardous to human occupants in the room where centrifugation is occurring. Also, this spray or mist can collect and cause dripping which coats the centrifuge or surrounding machinery, and may contaminate the solids expelled from the centrifuge into a waiting receptacle.

Another difficulty encountered is that some sticky solids refuse to let go of the blade during scraping. Different geometries are preferable to get the solid to peel off. However, each blade must be balanced to reduce vibration of the system, and it is expensive to produce and balance each blade properly. It would be advantageous if individual blades could be customized with different geometries for use in different applications. Other difficulties encountered with current blade designs are that they generally require a large amount of torque to operate. The application of large torque can sometimes result in the blade drive shaft breaking. Current blade designs also often possess a large surface area to which solids may stick. Designs in which the surface area is minimized while retaining equally effective scraping capacity and stilling action are desirable.

Other problems with centrifugal separation include difficulties in accurate measurement of the flow of contaminated liquid into the system. Since the liquid is contaminated with solid particles accurate measurement of the flow rate into the centrifuge is difficult and often requires the use of expensive equipment.

The present invention meets the demand for a coupling mechanism ensuring synchronous blade and bowl rotation in the centrifuge. Additionally, it minimizes the occurrence of spray and misting upon exit from the apparatus. Furthermore, it provides a solution to the problem of obtaining variable geometries using a standard blade with inserts. Also disclosed are blade designs for minimizing the torque required to operate the system as well as minimizing the surface area to which solids may stick while retaining effective scraping and stilling ability. A simple method for measuring flow is also disclosed along with a method for cleaning the blades of solids stuck thereon.

SUMMARY OF THE INVENTION

In one aspect of the invention the centrifuge comprises a spindle centered on a longitudinal axis with a top portion, a bottom portion, and a hollow interior extending along the longitudinal axis, a bowl attached to the bottom portion of the spindle and a drive shaft passing through the hollow interior with a plurality of scraper blades attached to the drive shaft. The centrifuge has a clutch mechanism comprising a shifting coupling attached to the blade drive shaft via a key locked in a rotary direction. The shifting coupling has a first set of teeth that interlockingly engage a second set of teeth. The second set of teeth are attached to the top of the spindle in one embodiment. In another embodiment the second set of teeth are attached to a pulley attached to the top portion of the spindle. The shifting coupling may be shifted upward and downward along the longitudinal axis between two positions. In the first position the first and second set of teeth are lockingly engaged so that the spindle and the scraper drive shaft rotate together. In the second position the first and second sets of teeth are disengaged.

In another aspect of this invention the centrifuge comprises a spindle configured to rotate about an axis. A bowl is attached to and rotates with the spindle. A drive shaft is received within a passageway of the spindle and rotates about the same axis. A scraper blade is attached to and rotates with the drive shaft. A mechanism is provided to selectively couple the drive shaft and spindle together to allow both to be driven by the same motor.

In another aspect of this invention the centrifuge scraping apparatus comprises blades with recesses on its front face adjacent the end of the blade next to the inner surface of the bowl. Inserts are placed in the recesses to give the scraper blade different cutting surfaces for contacting solids accumulated on the interior wall of the bowl.

In another aspect of the invention the centrifuge scraping kit comprises a rotatable scraper frame with a number of opposing ends. Each of the ends is adjacent the interior wall of the bowl and is also adjacent a front face of a blade in which a number of recesses are defined. A set of scraper inserts configured to plow solids accumulated on the interior wall of the bowl are placed in the recesses.

In another aspect of the invention the centrifuge comprises a housing with a rotatable bowl therein. The housing is cylindrical with a closed top end and an at least partially open bottom end. The housing has a tangential outlet which minimizes the entrainment of gas by a liquid exiting the bowl during processing.

In another aspect of the invention the centrifuge comprises a spindle attached to a bowl which rotate together. The centrifuge has a drive shaft which is received in a passageway defined by the spindle. The drive shaft is attached to scraper blades which rotate with the drive shaft. The centrifuge has means for selectively rotating the drive shaft and spindle together.

In another aspect of the invention, the centrifuge apparatus comprises a first scraping blade and a second scraping blade which rotate around a longitudinal axis. The first blade has a first forward face and a first rear face, each of the faces extend between a first radially inner edge which is located substantially along a first inner radius from the axis and a first radially outer edge located substantially along a first outer radius from the axis. The second blade has a second forward face and a second rear face, each of the faces extends between a second radially inner edge located substantially along a second inner radius and a second radially outer edge located substantially along a second outer radius. The first outer radius and second inner radius are such that the first and the second blades have at least some radial overlap.

In another aspect of this invention the centrifuge scraper blade assembly comprises a first and second pair of centrifuge blades which rotate around a longitudinal axis. The first pair of blades are substantially symmetrical around the longitudinal axis. Each of the blades of the first pair of blades has a radially inner edge substantially along a first radius and a radially outer edge substantially along a second radius. The second pair of blades are substantially symmetrical around the longitudinal axis, each of the blades of the second pair of blades has a radially inner edge substantially along a third radius and a radially outer edge substantially along a fourth radius. The second radius is at least equal to the third radius and the second radius is smaller than the fourth radius.

In another aspect of this invention the centrifuge apparatus comprises a plurality of scraping blades rotating around a longitudinal axis, each of the blades has a scraping face and a trailing face, and each face has a top edge, a bottom edge, an inner edge and an outer edge. At least the first portion of each blade radially overlaps at least a second portion of another of the plurality of blades.

Another aspect of the invention comprises a method of determining flow rate into a rotor assembly which has an accelerator, a chive motor, and a plurality of stilling vanes which comprises the steps of accelerating the rotor to speed, maintaining the rotor at speed and measuring a first baseline value of load. Additional steps include injecting a fluid into the rotor assembly, maintaining the rotor at speed while accelerating the fluid in the rotor assembly, and using a programmable logic controller to subtract the first value from the second value to obtain a third value. The third value is converted by the programmable logic controller into a flow race of the fluid being injected into the rotor assembly.

In another aspect of this invention the centrifuge apparatus comprises a centrifuge having a plurality of scraping blades rotating around a longitudinal axis. Each of the blades has a scraping face and a trailing face, the faces having a top edge and a bottom edge and an inner edge and an outer edge. At least one of the blades is angled to force the solids toward a discharge opening in the centrifuge.

BRIEF DESCRIPTION OF THE DRAWINGS

FIG. 8A is a top view of the blade assembly with recesses of the present invention.

DESCRIPTION OF THE PREFERRED EMBODIMENT

Figure 1:
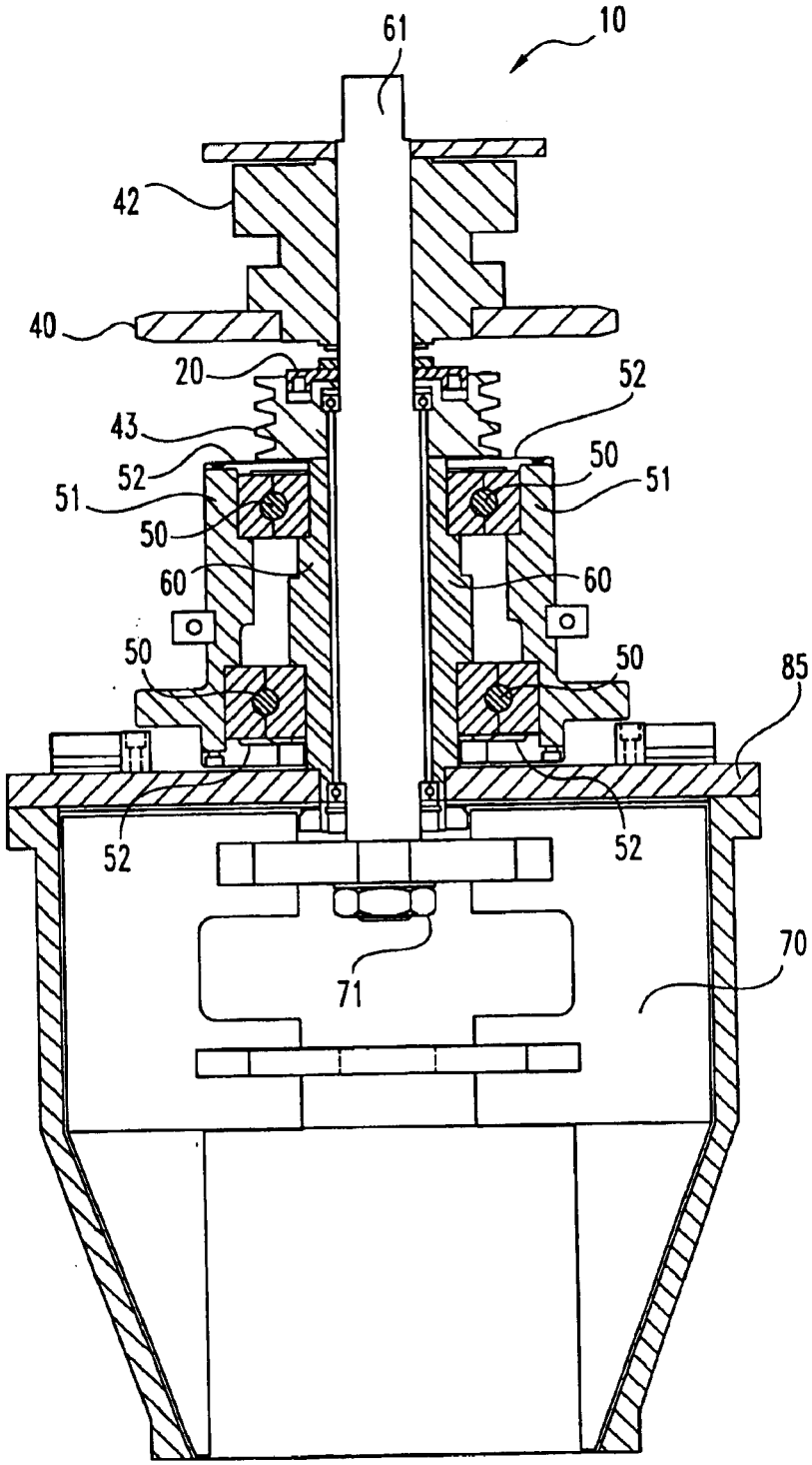
Fig. 1 (PRIOR ART)
FIG. 1 is a partial cross-sectional side view of a centrifuge assembly of the prior art with a frictional clutch mechanism.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated device, and any further applications of the principles of the invention as illustrated therein being contemplated as would normally occur to one skilled in the art to which the invention relates.

Figure 2:
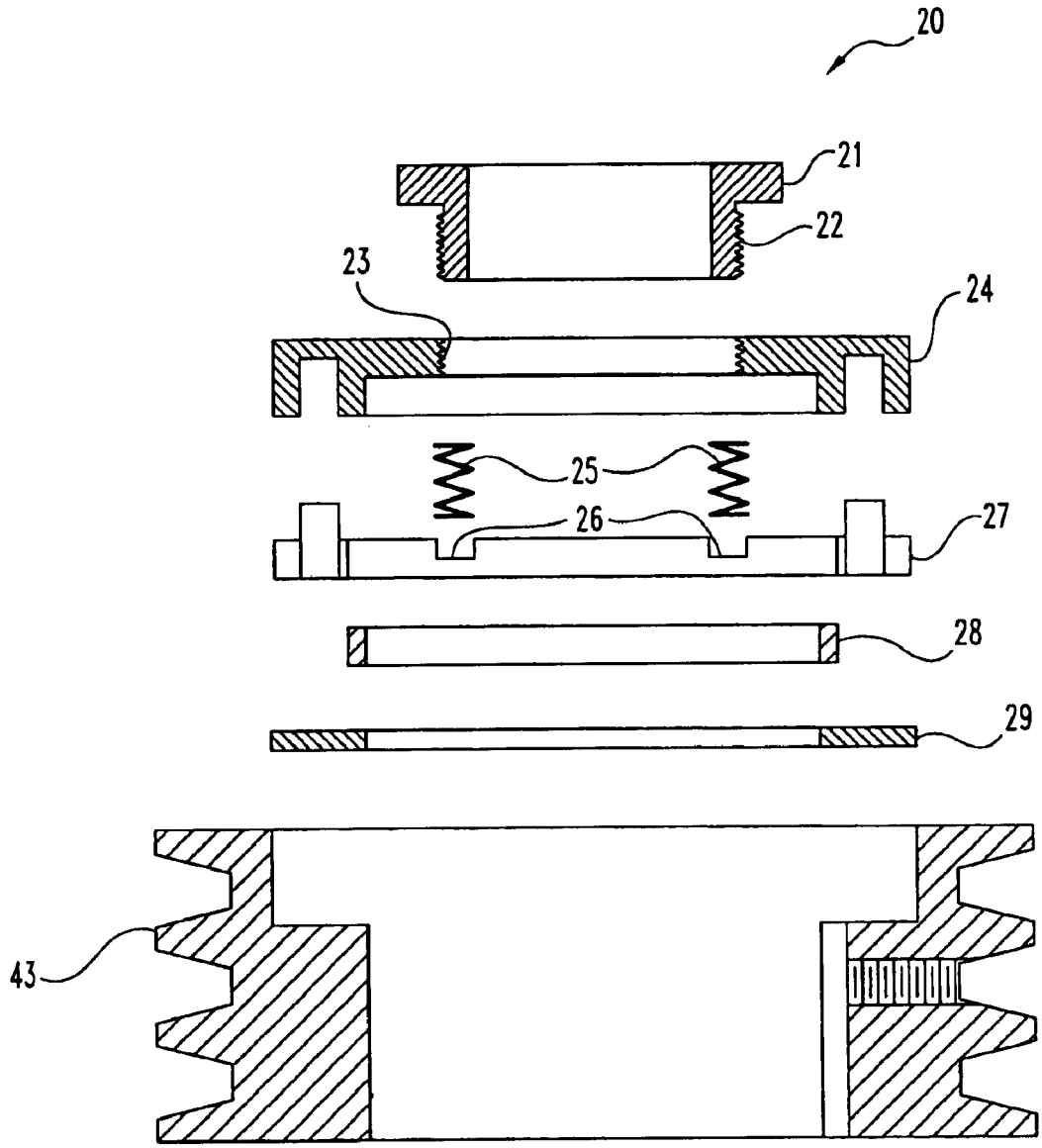
Fig. 2 (PRIOR ART)
FIG. 2 is an exploded, partial cross-sectional side view of the frictional clutch assembly which comprises a part of the FIG. 1 prior art centrifuge assembly.

In order to more fully illustrate the advantages of the present invention, the device of the prior art will be described. With reference to FIGS. 1 and 2, a prior art centrifugal separator with a frictional mechanism to ensure synchronous bowl and blade rotation is illustrated. A portion of the prior art assembly 10 is shown in FIG. 1 with more detail of the frictional clutch assembly 20 shown in FIG. 2.

The assembly 10 comprises a spindle 60 with a lower and upper end. Bowl 85 is fixedly attached to the lower end of spindle 60 and pulley 43 is affixed to the upper end of spindle 60. A scraper blade or stilling vane shaft 61 has an upper portion fixedly attached to a sprocket 40 and a lower portion affixed to a plurality of blades 70 by a nut 71 which holds blades 70 on shaft 61. Spindle 60 and shaft 61 are concentric and spindle 60 defines an internal passage through which shaft 61 is received. The centrifuge has main bearings 50, and bearing caps 52 located within bearing housing 51.

During processing, pulley 43 is driven by a belt (not shown) attached to a first motor (not shown) which provides motive force for turning spindle 60 and fixedly attached bowl 85 as well as shaft 61 and blades 70 through frictional clutch assembly 20. During the scraping mode motive force for the rotation of the shaft 61 and affixed blades 70 is accomplished by a chain (not shown) attached around sprocket 40 which is powered by a second motor (not shown). In the scraping mode only the sprocket 40 is being driven. The sprocket 40 is free floating until actuated by pneumatic clutch 42 which forces sprocket 40 to engage and override frictional clutch assembly 20.

Frictional clutch assembly 20 consists of an adjusting nut 21 with external threading 22. External threading 22 matches the internal threading 23 in adjusting plate 24. Adjusting plate 24 sits on four springs 25 spaced evenly around the circumference of pressure plate 27. The springs 25 are received in slots 26 defined by pressure plate 27. Pressure plate 27 rests on top of a bronze bushing 28. Bronze bushing 28 sits on friction disc 29 which sits on pulley 43. The friction disc 29 resists differences in rotational speed and is intended to ensure synchronous bowl 85 and blade 70 rotation.

The difficulties associated with use of the frictional clutch assembly 20 are numerous. For one, it has numerous parts subject to wear and replacement. Additionally, friction disc 29 does not provide a positive lock to ensure synchronous bowl and blade rotation, but, instead, the system must be constantly monitored to ensure bowl and blade rotation are occurring at the same rotational speeds. In operation, whenever the centrifuge is in scraping mode the user is causing it to overcome friction forces causing wear to frictional clutch assembly 20. Furthermore, as friction disc 29 wears, the difference in rotational speeds and the difficulty in obtaining synchronous blade and bowl rotation is increased.

With reference to FIGS. 3–6, an embodiment of the clutch mechanism for providing synchronous bowl and blade rotation of the present invention is illustrated. The centrifuge apparatus has a spindle 160 and scraper blade or stilling vane drive shaft 161. Spindle 160 has a hollow interior defining a passageway extending along the longitudinal axis L around which spindle 160 and shaft 161 rotate. Shaft 161 is concentric with spindle 160 and passes through the passageway defined by the hollow interior of spindle 160. The spindle 160 is journalled on main bearings 150 which are received in bearing caps 152 within bearing housing 151. The shaft 161 is journalled on scraper bearings 153 which are held in place by bearing retainer rings 153*a*. Bowl 185 is held on spindle 160 by retainer ring 154 and nut 155. Seals 156 and 156*a* aid in preventing fluid from escaping centrifuge bowl 185 and contacting bearings 153 or 150. In one embodiment, centrifuge bowl 185 has an inverted cup shape and the centrifuge is an inverted bowl automatic self-discharging centrifuge. It is understood, however, that other types of centrifuges, including those with openings for exiting liquids at the top instead of the bottom of the bowl, are contemplated as within the scope of the invention.

Spindle 160 has a top portion to which pulley 143 is fixedly attached and a bottom portion to which bowl 185 is affixed. More specifically, the bottom portion of spindle 160 is affixed to bowl lid 186. Motive force for rotating spindle 160 and bowl 185 is provided by a belt 208 on pulley 143 (see FIGS. 5 and 6) which in turn is driven by motor 207. It is understood that throughout the entirety of this invention that alternative drive mechanisms such as a sprocket and chain combination may be used interchangeably with the pulley and belt combination.

Shaft 161 is affixed to blades 170 at the bottom end of shaft 161. It is understood that the centrifuge may possess two or more blades. The blades 170 are held by a nut 171 on shaft 161. The shaft 161 has threading upon which nut 171 is screwed and possesses further threading below nut 171 upon which impeller or accelerator 172 is screwed. The impeller 172 may have a nut welded on it, so that in an alternative embodiment blades 170 are held on shaft 161 by impeller or accelerator 172 alone. Centrifuge bowl 185 has an exterior surface 179 and an interior surface 180. Centrifuge bowl 185 at the top portion has a lid 186 with external surface 181 and internal surface 182. Gaskets or O-rings 183 are provided to prevent leakage of liquid from the lid 186 of bowl 185.

Figure 3:
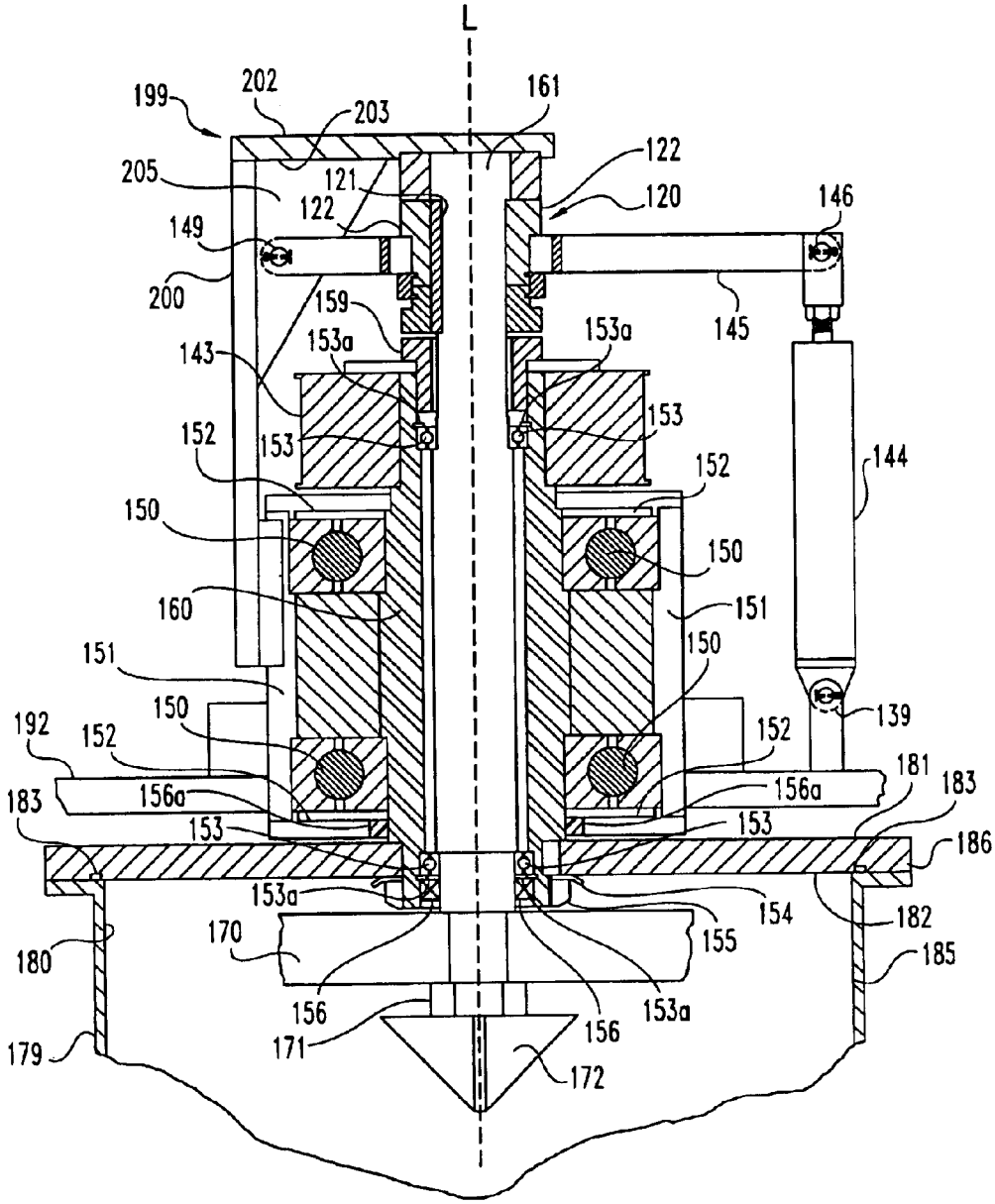
FIG. 3 is a partial cross-sectional fragmentary view of the clutch mechanism and drive assembly according to a typical embodiment of the present invention.
Figure 4:
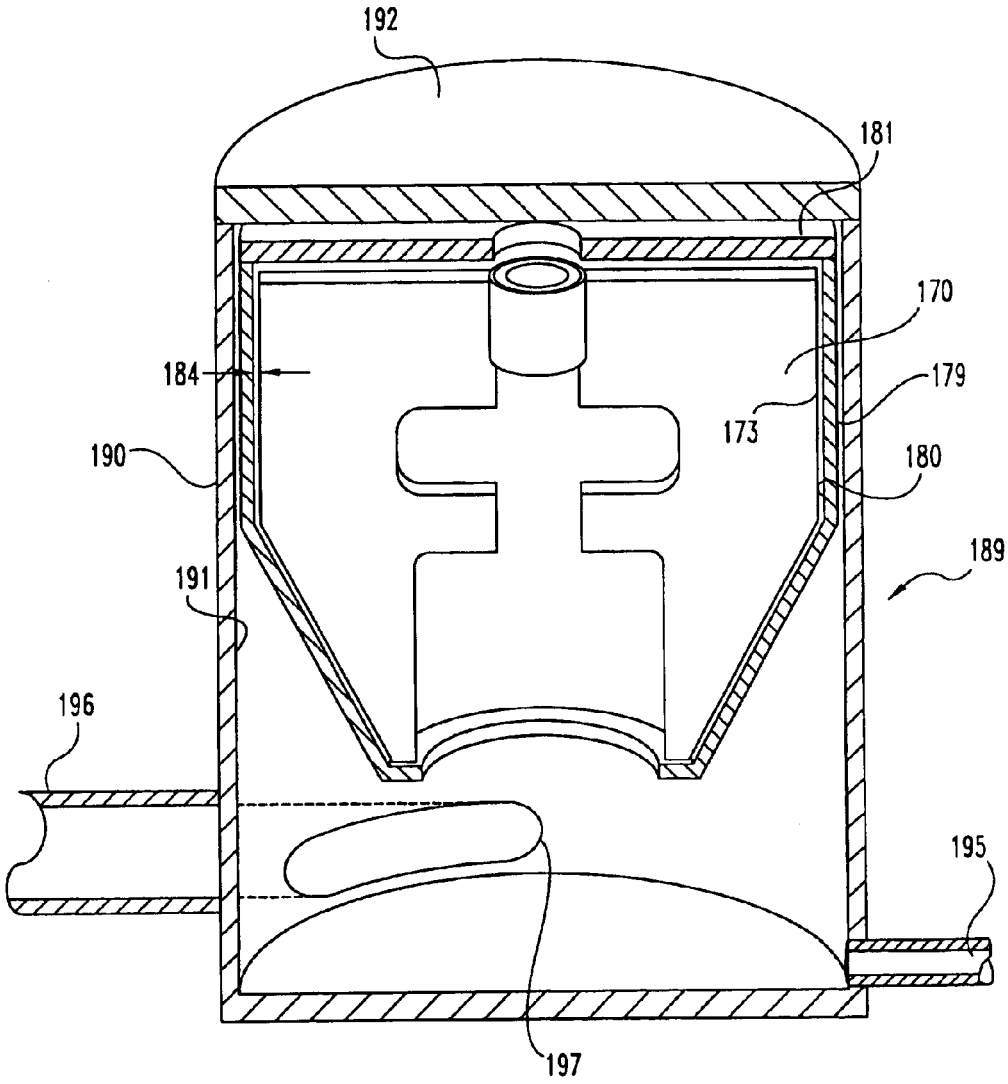
FIG. 4 is a perspective view of the housing with bowl and blades of the present invention.
Figure 5:
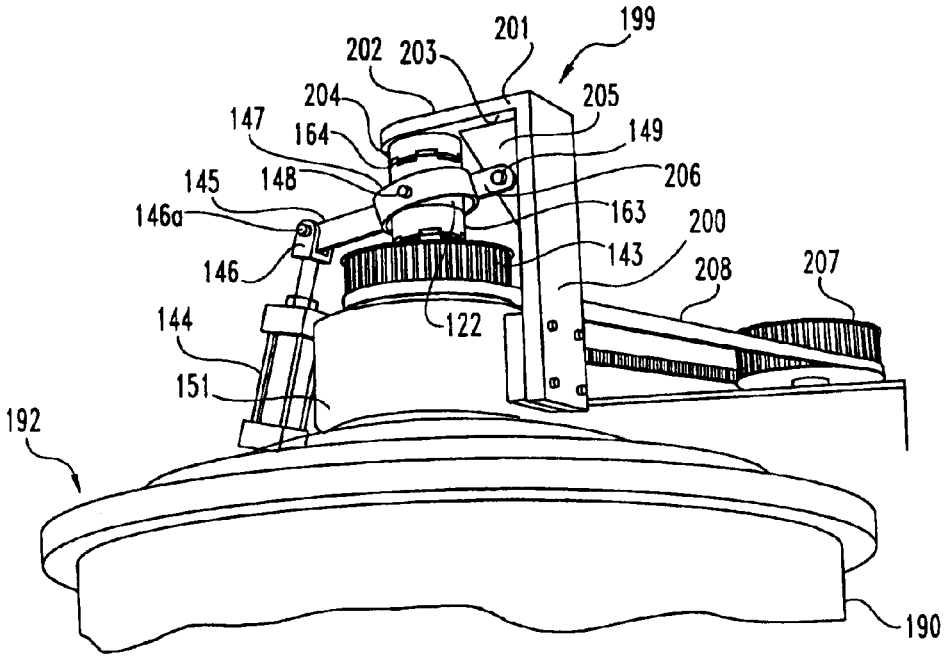
FIG. 5 is a perspective side view of the clutch mechanism and drive assembly according to a typical embodiment of the present invention.
Figure 6:
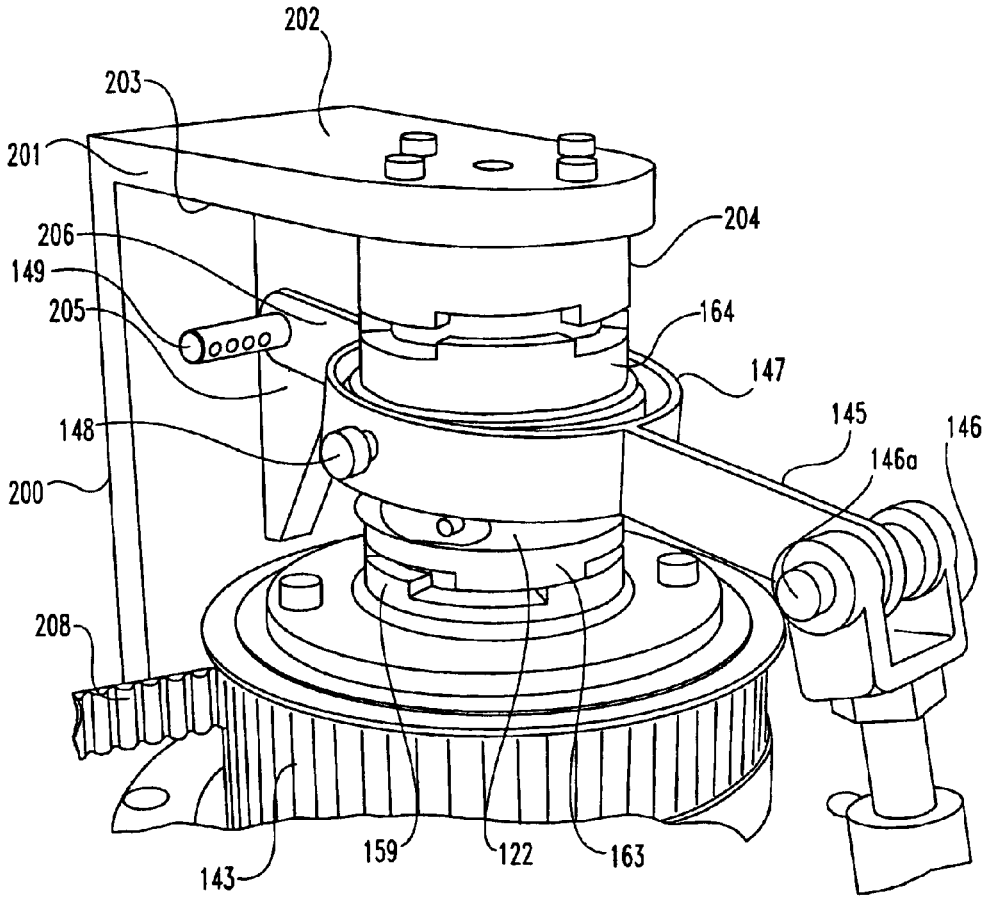
FIG. 6 is another perspective side view of the clutch mechanism and drive assembly according to the same embodiment of the present invention.

With reference to FIGS. 3 and 4, centrifuge bowl 185 and blades 170 rotate within a housing 189 with a top 192 and a cylindrical portion with exterior surface 190 and interior surface 191. The housing 189 has an inlet tube 195 which provides liquid with solids in suspension to the bottom injector (not shown) which injects it upward into rotating blades 170 and bowl 185. It is understood that alternative injection arrangements, including top injectors wherein liquid is provided through a passageway defined within the interior of drive shaft 161 are within the scope of the invention. An outlet port 196 from a tangential outlet 197 exits the housing 189 to a storage location or a drain for the liquid from which solids have been centrifuged. In some cases, the exiting liquid may be immediately injected back into whatever application it becomes contaminated in.

Each of blades 170 has an edge 173. In one embodiment, the clearance or gap 184 between blade edges 173 and bowl interior surface 180 is on the order of 2 mm. Solids may coat the bowl interior surface 180, thus reducing wear, and fill the gap 184. It is understood that clearance 184 may be greater or lesser than 2 mm.

The clutch assembly 120 is moved upward and downward by a pneumatically driven shifter 144. Shifter 144 is affixed at bottom portion 139 (FIG. 3) to the top of housing 192. In an alternative embodiment, the bottom portion 139 of shifter 144 may be affixed to the exterior surface of bearing housing 151. It is understood that the bottom portion 139 of shifter 144 may be affixed to any convenient non-rotating surface. The top portion 146 of shifter 144 engages a bar 145 which is pivotally connected to shifter 144 by a clevis pin 146*a*. Bar 145 is affixed to mating structure 147 which encircles or otherwise surrounds jaw or shifting coupling 122. Shifting coupling 122 is attached to shaft 161 by a key 121 (FIG. 3). In a preferred embodiment key 121 should be two flats on the shaft. Coupling 122 may possess any geometry which will mate with shaft 161 and not allow it to slip in a rotating fashion. That is, coupling 122 has a geometrical mating surface that does not permit rotational motion relative to shaft 161, but coupling 122 can slide up and down along the longitudinal axis L of shaft 161. While it is preferable that the upward and downward movement of shifting coupling 122 be accomplished with shifter 144, it is understood that bar 145 may be moved manually or by any actuating device such as a ball screw, electric actuator or spring loaded device.

It is contemplated that alternative geometrical mating surfaces for coupling 122 other than a circular profile are within the scope of the invention. It is understood that almost any geometry such as square, pentagonal, hexagonal, etc. may be used. It is further understood that spindle 160 and shaft 161 are also not limited to a circular profile. In a similar manner, mating structure 147 is not limited to a geometry that conforms to or encircles shifting coupling 122 and may be any structure that will allow shifting of shifting coupling 122, including, but not limited to, a fork structure. Shifting coupling 122 is rotatably affixed to mating structure 147 by bolts or screws 148. It is understood that alternative fastening mechanisms such as welding, adhesives, and other means known in the art may be used to affix mating structure 147 to shifting coupling 122. It is further understood that mating structure 147 is attached to an insert of two fingers which permit shifting coupling 122 to rotate.

On the opposite side of mating structure 147 from bar 145 is a second bar 206 which is pivotally connected by bolt or screw 149 to plate 205. The triangular plate 205 is part of support structure 199. Support structure 199 has a longitudinally extending portion 200 generally parallel to the longitudinal axis L of spindle 160 and shaft 161. Support structure 199 is L-shaped and further possesses a portion 201 attached to the top of longitudinal portion 200 and extending in a radial direction. Radial portion 201 has a top surface 202 and a bottom surface 203. Triangular portion 205 extends between longitudinal portion 200 and radial portion 201 of support structure 199. It is understood that the support structure may be made out of materials such as metal, ceramics, and composites so long as the material selected possesses sufficient strength to withstand the stresses put on it. It is further understood that support structure 199 may have geometries other than the L-shape described herein.

In one embodiment, support structure 199 is affixed at the bottom portion of longitudinal portion 200 to the exterior surface of bearing housing 151. In an alternative embodiment, support structure 199 is attached to the housing top 192. It is understood that support structure 199 may be attached to any non-rotating portion of the centrifuge in a variety of manners. It is further understood that support structure 199 may also be attached to something other than the centrifuge, such as a plate of another larger outer housing containing the entirety of the centrifuge or even the ceiling of the room in which the centrifuge is located.

Shifting coupling 122 has a set of teeth or other geometrical mating or engagement means 163 on its bottom end facing downward. Additionally, shifting coupling 122 has a set of teeth 164 on its top end facing upward. The set of teeth 163 on shifting coupling 122 facing downward are sized for interlocking engagement with an equal number of teeth 159 facing upward on the top portion of spindle 160. It is understood that set of upward facing teeth 159 may be affixed directly to pulley 143 instead of spindle 160. It is further understood that set of upward facing teeth need not possess the same number of teeth as set of downward facing teeth. In a similar manner, set of teeth 164 are sized for interlocking engagement with an equal number of teeth 204 facing downward affixed to the bottom surface 203 of radial portion 201 of support structure 199. In one embodiment, set of teeth 163 and set of teeth 164 are identical. It is contemplated as within the scope of the invention, however, that set of teeth 163 and set of teeth 164 may be of different sizes and possess a different number of teeth or other engagement or interlocking means. In one embodiment, set of teeth 163 and 164 each possess three rectangular shaped teeth formed on the circumference of shifting coupling 122. It is understood that each set of teeth may possess between one to more than twenty teeth. It is further understood that the set of teeth or other engagement or interlocking means may have a profile other than rectangular, including, but not limited to, triangular, trapezoidal, or even an arc of a circle.

It is contemplated as within the scope of the invention that the directions set of teeth 163 and 159, and sets of teeth 164 and 204, respectively, extend toward may be varied so long as the directions used permit interlocking engagement. For example, set of teeth 163 could face radially outward and set of teeth 159 could face radially inward or vice-versa. Additionally, set of teeth 163 could extend along the longitudinal axis and engage set of teeth 159 extending in a radial direction or vice-versa. Additional variations as would occur to a person of ordinary skill in the art are contemplated as within the scope of the invention and may be applied to sets of teeth 164 and 204 as well. These variations may include placing sets of teeth 163, 164 on the sides of shifting coupling 122 instead of the bottom and top surfaces respectively.

Figure 7:
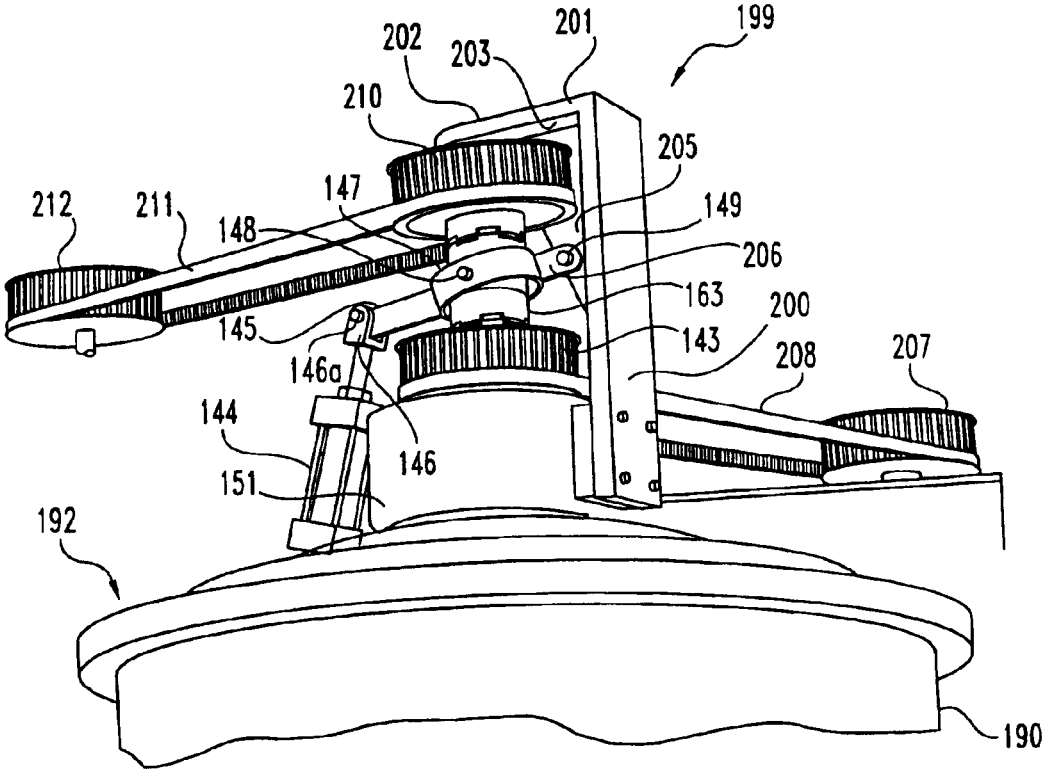
FIG. 7 is a perspective side view of the clutch mechanism and drive assembly according to a second embodiment of the present invention.
Figure 8C:
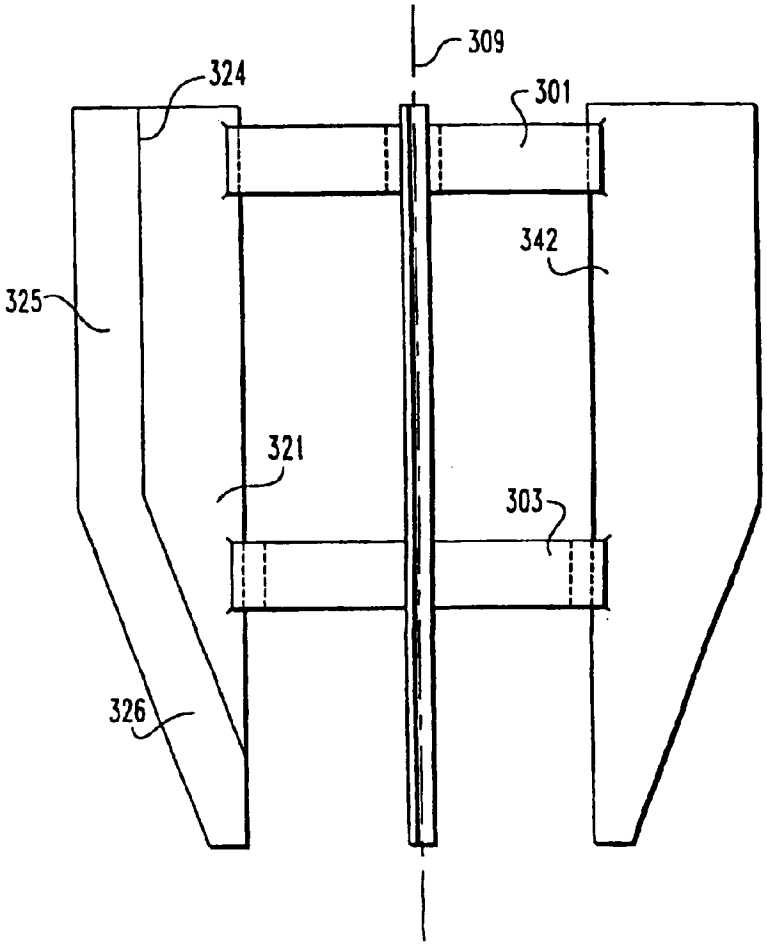
FIG. 8C is a side view of the blade assembly with recesses of the present invention in the 8C—8C direction of FIG. 8A.
Figure 8B:
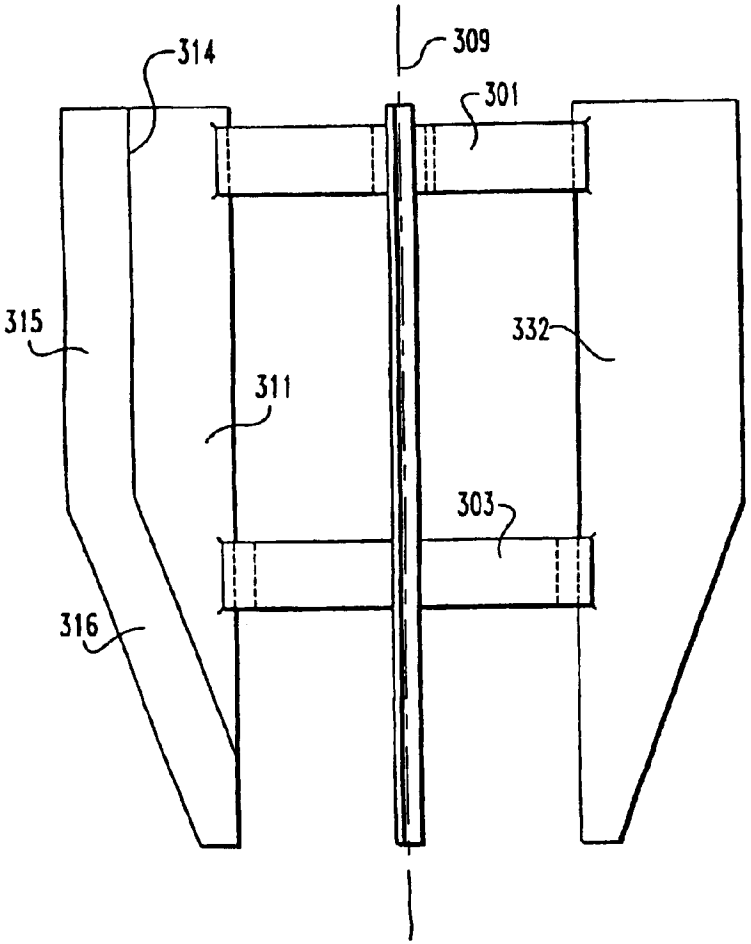
FIG. 8B is a side view of the blade assembly with recesses of the present invention in the 8B—8B direction of FIG. 8A.
Figure 8E:
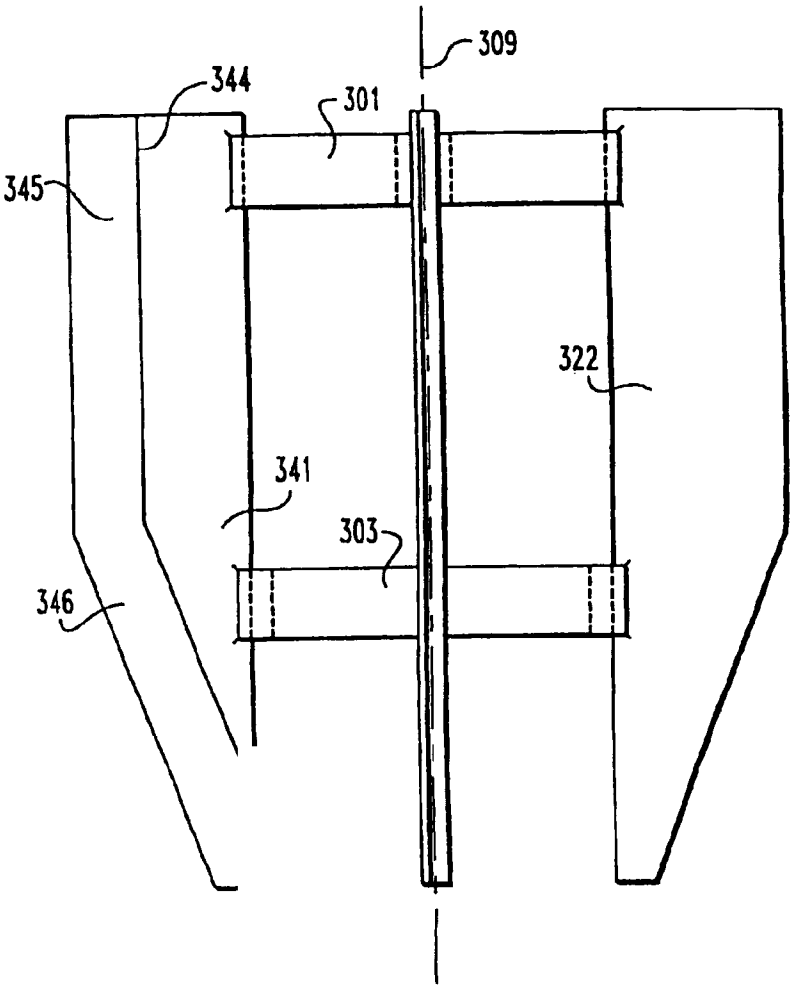
FIG. 8E is a side view of the blade assembly with recesses of the present invention in the 8E—8E direction of FIG. 8A.
Figure 8D:
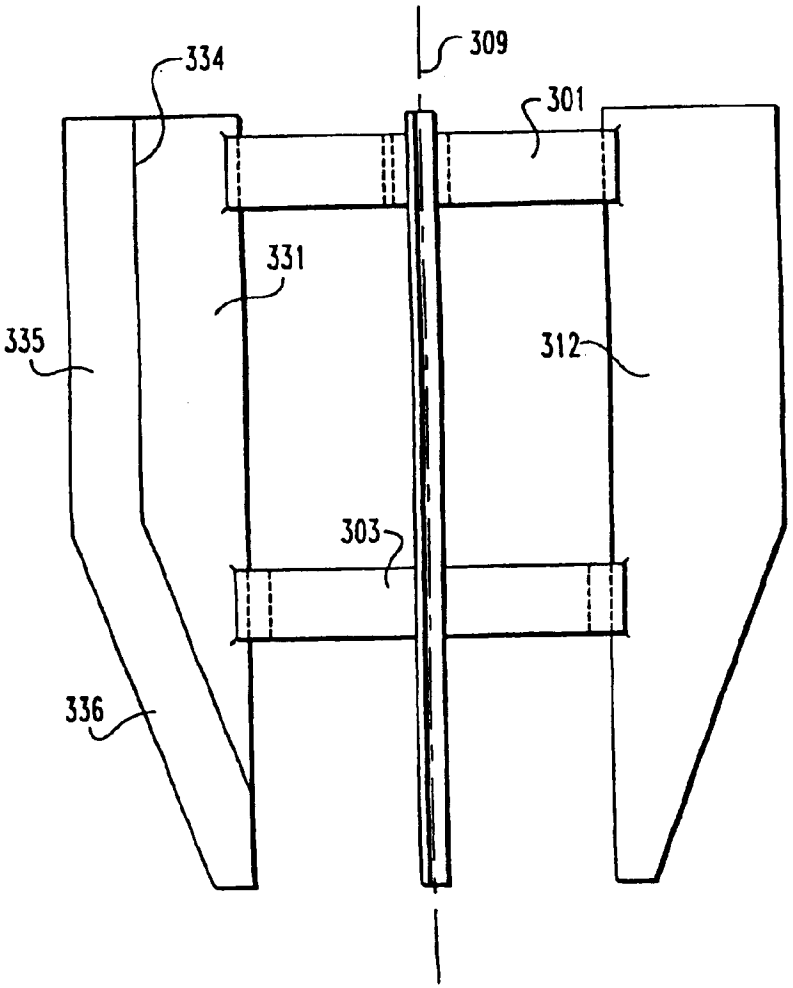
FIG. 8D is a side view of the blade assembly with recesses of the present invention in the 8D—8D direction of FIG. 8A.
Figure 9A:
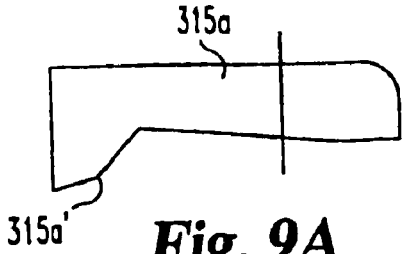
FIGS. 9A–9D are top views of examples of various inserts for placement in the recesses of the blade assembly of FIGS. 8A–8E.
Figure 9B:
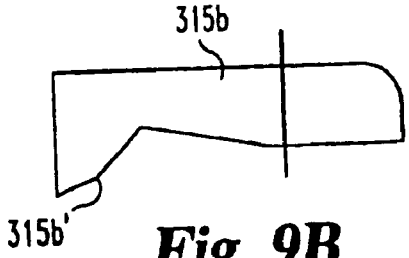
Figure 9C:
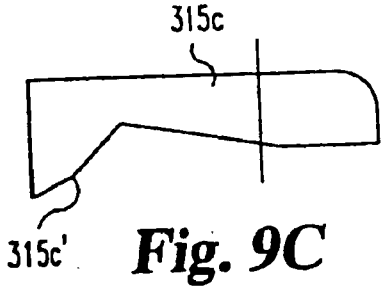
Figure 9D:
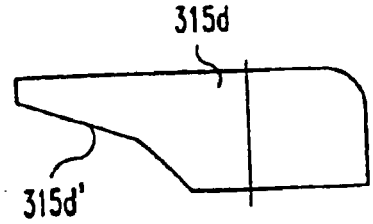

With reference to FIG. 7, an alternative embodiment of the invention is illustrated. In FIG. 7, like objects are labeled as previously. The difference in this embodiment is that instead of having stationary or immovable set of teeth 204, a sprocket 210 is attached to the bottom surface 203 in such a manner that it may rotate. Sprocket 210 is affixed to set of teeth 204 which are sized for interlocking engagement with the set of teeth 164 on the top of shifting coupling 122. Sprocket 210 is driven by chain 211. Motive force is provided to chain 211 by a second motor 212. In operation, this embodiment allows the scraper blades to be driven in a direction opposite that of the bowl during the scraping mode of centrifugal separation. Since the bowl and the blades rotate in opposite directions, the time necessary to effectively scrape the interior of the bowl of solids is correspondingly reduced. Alternatively, the scraper blades may be driven in the same direction as the bowl but at a different speed so that bowl and blades rotate relative to one another, and scraping occurs.

Another variation contemplated within the scope of the invention, while not preferred, is the use of a shifting coupling 122 with a set of teeth (or other geometrical mating or engagement means) on one end and a frictional clutch mechanism as known in the prior art on the other end. This is the least preferred of all modes since use of the frictional clutch mechanism on one end introduces many of the problems solved by the present invention back into the centrifuge system. It does, however, provide improvements over the frictional clutch mechanism of the prior art including the use of one motor which would not be present without the positive lock present on at least one end of the shifting coupling.

The advantages of this clutch or coupling mechanism are numerous. This clutch mechanism positively locks the scraper blades or stilling vanes with the drive mechanism that drives the bowl. This ensures the same rotational speed for both bowl and blade, and keeps the liquid within the bowl from slipping, resulting in higher efficiencies during operation. This design also allows the centrifuge to be operated with one motor as opposed to two. Even in the embodiment described above with two motors, the second motor need only be run during scraping time. As a result, the design of the present invention is a much less complicated assembly and the change-out time for replacing parts is greatly lowered. For example, the GLASSLINE prior art devices such as DL 75, DL 175, or DL 275 manufactured by GLASSLINE Corporation, of Perrysburg, Ohio previously described takes 4–6 hours to change-out by an experienced mechanic familiar with the system. In contrast, in the embodiment described above where set of teeth 204 are stationary, it took less than 30 minutes for the same mechanic to change-out the second time it was done.

Additionally, it will be noted that this clutch assembly has fewer parts than the prior art frictional clutch assembly and requires no lubrication leading to a longer lifetime. Moreover, the design of the clutch assembly of the present invention allows the user to shift on-the-fly reducing scraping time correspondingly. To illustrate the advantages of shifting on the fly, the operation of the centrifuge will be discussed briefly. During processing shifter 144 is shifted downward so that set of teeth 163 on shifting coupling 122 are in interlocking engagement with set of teeth 159 located on either spindle 160 or pulley 143. Thus, pulley 143 is driving both spindle 160 and affixed bowl 185 as well as shaft 161 and affixed scraper blades or stilling vanes 170. When shifting on the fly, shifter 144 is shifted upward so that set of teeth 164 on top of shifting coupling 122 are in interlocking engagement with set of teeth 204 which are stationary and affixed to support structure 199. Thus, stilling vanes 170 are stationary while bowl 185 continues to rotate, and scraping occurs since stilling vanes 170 are moving relative to bowl 185. This is advantageous because when scraper blades 170 rotate to scrape, they can fling the solid out past the receptacle. Because the bowl 185 rotates as opposed to scraper blades 170, the solid falls under the influence of gravity down into a waiting receptacle (not shown).

Furthermore, the present design minimizes the amount of unsupported shaft 161 from approximately seven inches in the prior art devices to on the order of two inches in the present device. Even the two inches in the present invention possess support from the teeth which are affixed to the support assembly in one embodiment. The minimization of the amount of unsupported shaft reduces the possibility for vibration and potentially destructive oscillation. Additionally, this design does not require any parts to be hanging on the unsupported portion of shaft 161.

Centrifugal separation operating in the low to mid range of zero to two thousand g's allows the extraction of solid particles from a contaminated liquid containing a liquid and solid particle in suspension. Motor 207 need only produce 7.5 to 10 hp to operate one embodiment of the centrifuge, in which bowl 185 has a processing volume of 6 gallons, in this range. One motor used is the 10 hp, 3600 max rpm motor manufactured by Lincoln Electric Part No. LM16243TF6255/1, of Cleveland, Ohio. Different size centrifuges, however, will have different power requirements of motor 207. Another added benefit of this invention is that the reduction in the amount of unsupported shaft 161, as well as the minimization or lack of parts hanging from it, allow the use of larger centrifugal forces in excess of 2000 g's. Filtration of smaller particles is possible with larger centrifugal forces.

Additionally, the use of larger centrifugal forces lowers the residence time for a particular size solid, which is the amount of time the liquid is in the bowl and under centrifugal force so that the solids in the liquid are forced out to the wall. Thus, because of the reduction in residence time available using larger centrifugal forces and the reduction in scraping time available from shifting on the fly, total processing time is reduced. This allows the use of a smaller system to process the same amount of liquid in the same amount of time. As a result, a wide variety of centrifuges and motor sizes are contemplated as within the scope of the invention. Similarly, a correspondingly wide variety of centrifugal forces extending from the zero to two thousand g's previously used to more than two thousand g's as now possible with this invention are contemplated as within the scope of this invention.

With reference to FIGS. 8 and 9, another aspect of the present invention is illustrated. The solids in suspension in the liquid are often sticky and refuse to let go of the scraper blade. In this situation, different scraping edge geometries are often necessary to get the solids to peel off the scraper blade. The scraper blades, however, are expensive and must be individually balanced to reduce the potential for destructive oscillation. Illustrated in FIGS. 8A–8E is a scraper blade assembly 300. Blade assembly 300 has blades 310, 320, 330, and 340 which are affixed to plate 301 on their top portion and which are further affixed to ring 303 on their bottom portion. Plate 301 has an opening 302 in its center through which the bottom portion of the centrifuge drive shaft (not shown) passes. Blades 310, 320, 330, and 340 have front faces 311, 321, 331, 341, back faces 312, 322, 332, 342, and ends 313, 323, 333, and 343, and recesses 314, 324, 334, and 344, respectively. The recesses 314, 324, 334, 344 are defined on the front faces 311, 321, 331, 341 adjacent ends 313, 323, 333, 343, respectively. Into recesses 314, 324, 334, 344, different inserts 315 and 316, 325 and 326, 335 and 336, 345 and 346, respectively, are attached by screws, bolts or adhesives for different applications such as oil, water, acid and other liquids with solids in suspension. The use of recesses with inserts received therein for the blade assembly 300 allows the cutting geometry of blade assembly 300 to be easily customized based on the liquid-solid combination being separated. It is understood that blade assembly 300 may have as few as two or more than four blades.

The base scraper blade assembly 300 is the same for each centrifuge. The base blade assembly 300 may be balanced and the inserts added afterward. As long as the inserts 315 and 335, 316 and 336, 325 and 345, 326 and 346, respectively, have the same mass, the blade assembly 300 will remain balanced. This eliminates the need to rebalance the blade assembly 300 for vibration control. This invention permits the use of easily varied geometries along a single blade cutting edge of blade assembly 300. Even greater efficiencies may be obtained by mixing and matching geometries on the same blade since heavier solids may accrete in different places on the bowl than the lighter solids. For example, the geometry of insert 315 and that of insert 316 and correspondingly the geometry of insert 325 and insert 326 may be varied on one edge to provide the most effective cutting surface for the different solids at different elevations along the longitudinal axis of the bowl. FIGS. 9A–9D illustrate top views of four examples for cutting surface profiles 315*a*', 315*b*', 315*c*', 315*d*' for the inserts 315*a*, 315*b*, 315*c*, 315*d*. It is understood that other cutting surface profiles are within the scope of the invention.

It is contemplated as within the scope of the invention that if geometry permits, a single insert might be placed within recesses 314, 324, 334, and 344 of blade assembly 300. It is understood that more than two inserts may be placed within any recess 314, 324, 334, and 344 if more than two different cutting edge geometries are necessary. It is also understood that any single insert may be formed to have a varying scraping edge profile along its length. In a preferred embodiment, inserts 315 and 335, inserts 316 and 336, inserts 325 and 345, and inserts 326 and 346, respectively, have not only the same mass, but are also mirror images of one another around the centerline 309 which scraper blade 300 rotates.

This aspect of the invention is useful because it solves the problems previously discussed. Each base scraper blade assembly 300 costs approximately $1500.00 to $2000.00. The use of the same base scraper blade assembly permits the varying of the cutting edge geometry in a much simpler and more economical fashion. Simpler because it is much easier to machine the inserts then the blade assembly, and more economical because it allows the use of the same base scraper blade assembly.

Figure 10:
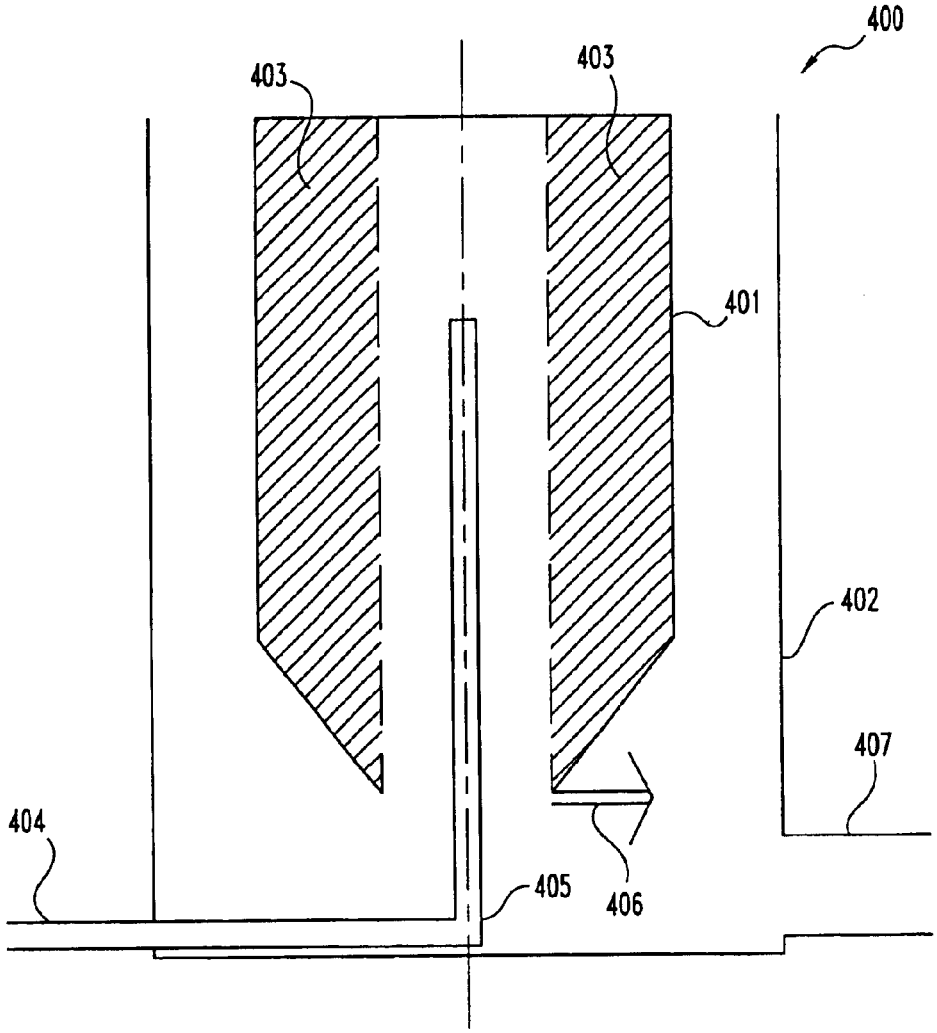
Fig. 10 (PRIOR ART)
FIG. 10 is a side view of the operation and exiting of fluid from within the centrifuge bowl of the prior art.
Figure 11:
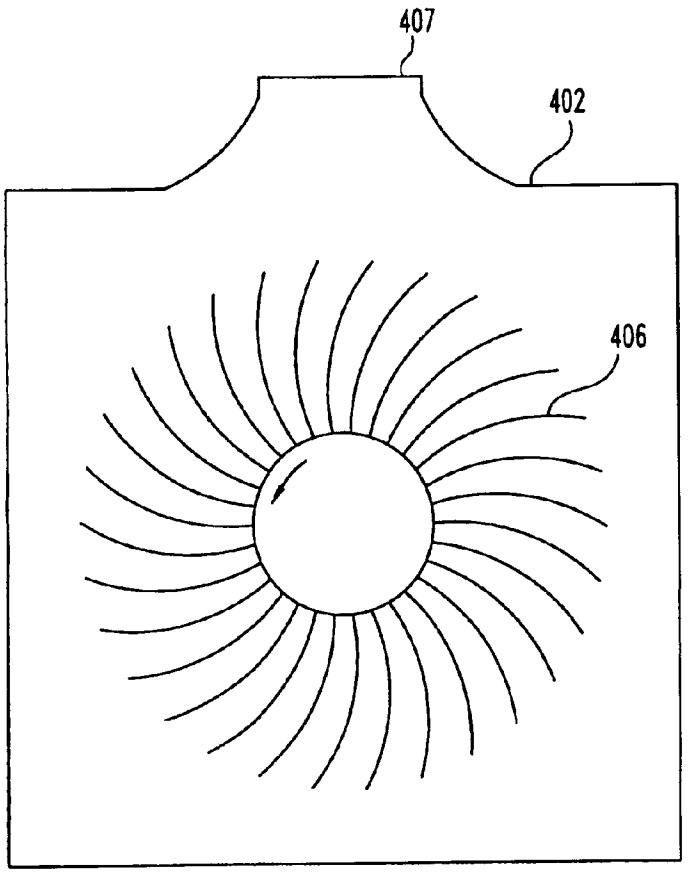
Fig. 11 (PRIOR ART)
FIG. 11 is a top view of the operation of the prior art device of FIG. 10.
Figure 13:
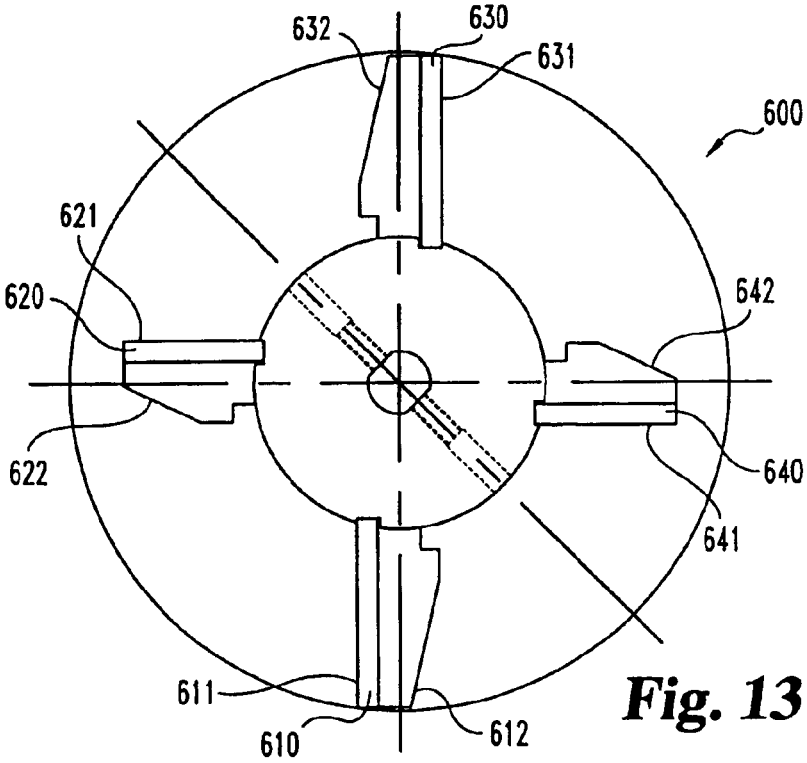
FIG. 13 is a top view of another embodiment of the scraping blade assembly.
Figure 14:
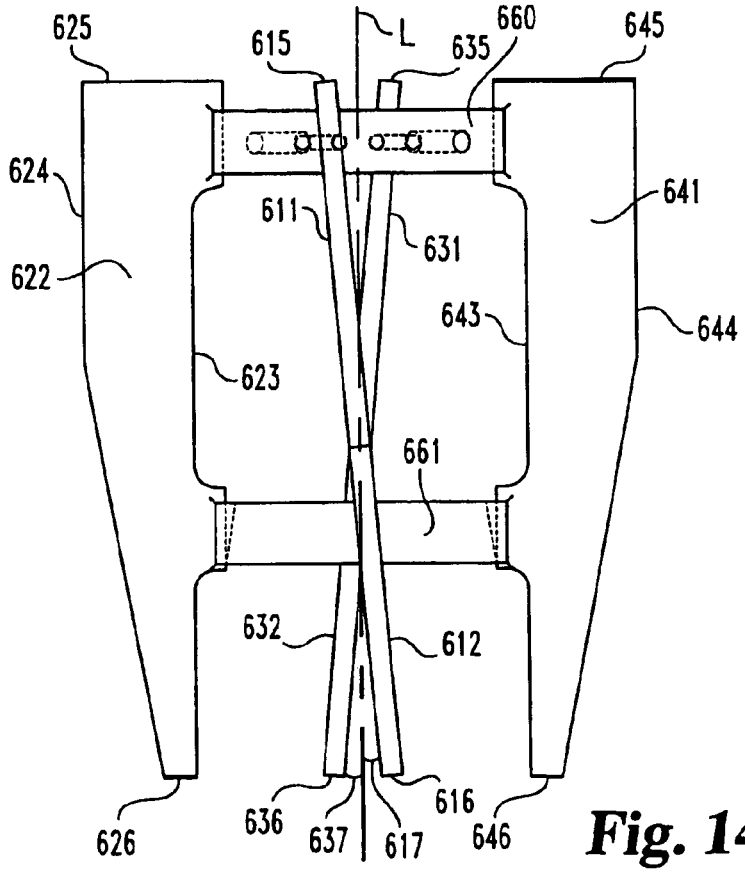
FIG. 14 is a side view of the scraping blade assembly of FIG. 13 depicting the inner blades.
Figure 15:
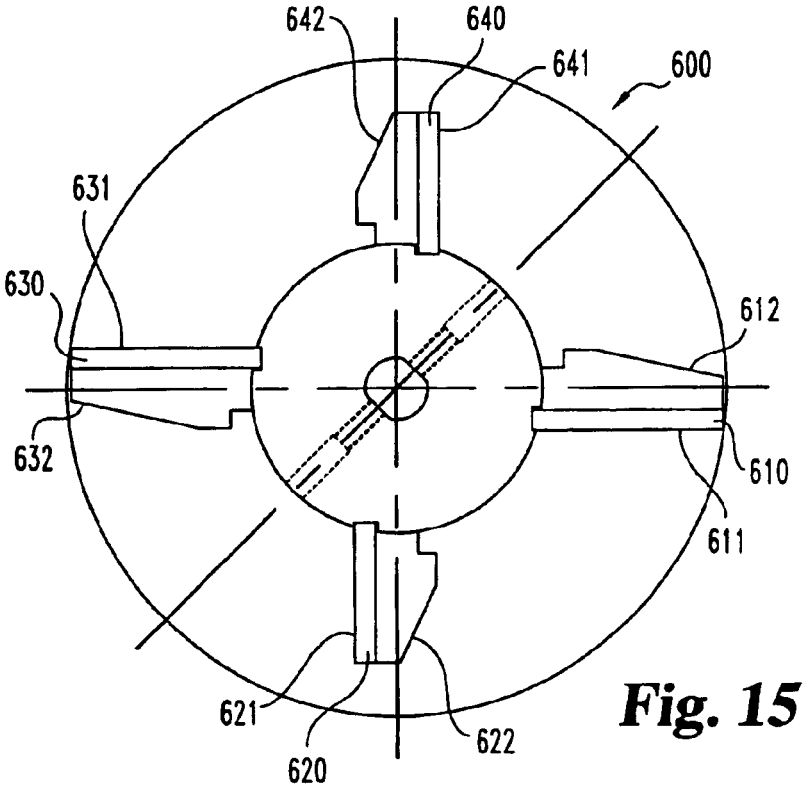
FIG. 15 is a top view of the same embodiment of FIG. 13 in which the blades have been rotated ninety degrees.
Figure 16:
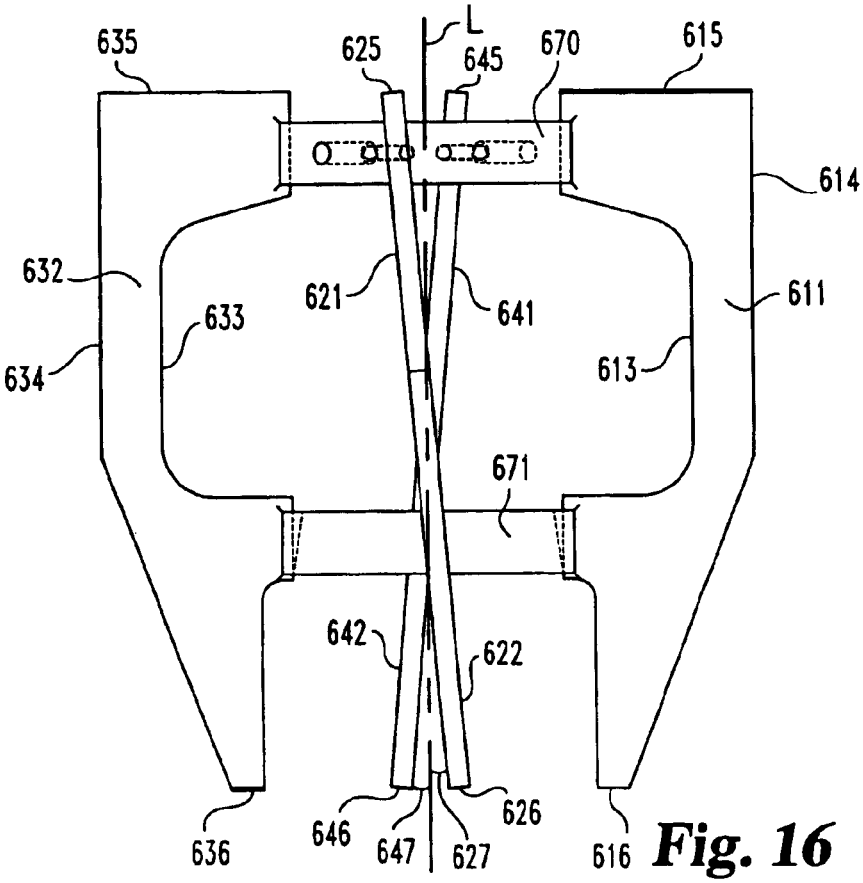
FIG. 16 is a side view of the scraping blade assembly of FIG. 15 depicting the outer blades.

With reference to FIGS. 10 and 11, there is illustrated the design by which liquid exits the centrifuge after processing. Contaminated liquid enters the housing 402 through inlet port 404 and is injected upward into the rotating bowl 401 by bottom injector 405. The injected liquid stays within the bowl 401 until the shaded regions (FIG. 10) illustrating the processing volume 403 are full. After processing volume 403 is full continued injection of liquid into bowl 401 results in the overflow of centrifuged liquid at the bottom lip of bowl 401 as indicated by arrow 406 in FIG. 10. Since the bowl is rotating as indicated by the arrow in FIG. 11, the centrifuged liquid has both tangential and radial velocity components. This results in the spray path 406 as illustrated in FIG. 11. The liquid exits the housing 402 through outlet port 407.

Figure 12:
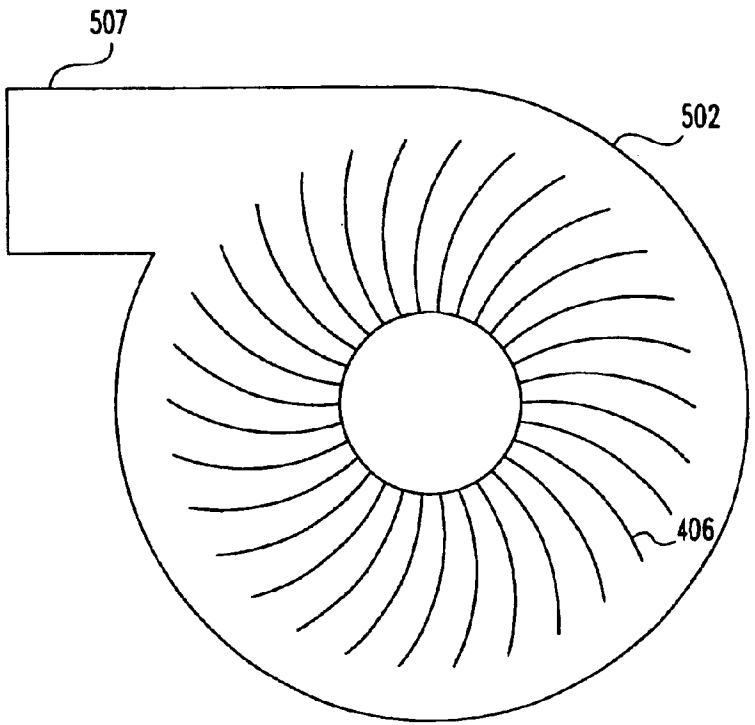
FIG. 12 is a top view of the operation of the fluid exiting the bowl of the present invention.

In the devices of the prior art, housing 402 was square and outlet port 407 was positioned on one side of housing 402. In the improvement of the present invention, as illustrated in FIG. 12, housing 502 is circular and has a tangential outlet port 507. The tangential outlet in this design results in less splash. It is understood that this aspect of the invention may be used with a top feed injector or a top fluid exiting centrifuge or both. The tangential outlet takes advantage of liquid rotation, as opposed to simply falling out under the influence of gravity, it generates an exit velocity. This reduced splash prevents the formation of a mist or spray that could cloud the room and endanger human occupants when toxic materials are being centrifuged. Another advantage of this tangential outlet that has been noted by the inventor is that when liquid is being injected into the system and exiting during processing, its exit through the tangential outlet creates a suction/vacuum. Thus, any misting that occurs does not flow up between the exterior surface of the bowl and the interior surface of the housing. This aids in the prevention of buildup of deposits or crusting on the exterior surface of the bowl and the interior surface of the housing.

The scraper blades/stilling vanes have three main functions in an automatic centrifuge. The first function is to accelerate the fluid being injected into the rotating assembly. The second function is to act as a stilling vane to keep the fluid as quiet as possible in the rotor assembly for efficient separation of the solids from the liquid. The third function is to aid in removal of the solids from the bowl. With reference to FIGS. 13–18, there are depicted a variety of embodiments of improved blade designs of two or more blades wherein there is at least one narrow outer blade and a wide inner blade. The outer blade is used for scraping the solids from the bowl wall, and if the solids cake is built up enough, the inner blade also scrapes the solids. The outer blade and inner blade effectively overlap each other within the fluid such that the fluid is kept compartmentalized and thus quiet for maximum efficiency. Since the outer blade is narrow, there is less surface area for solids to stick.

In particular, one embodiment of the improved scraper blade/stilling vane design is shown in FIGS. 13–16. Scraping blade assembly 600 has a first outer blade 610, a first inner blade 620, a second outer blade 630, and a second inner blade 640. The blades 610, 620, 630, 640, have a forward or scraping face 611, 621, 631, 641, a rear or trailing face 612, 622, 632, 642, a radially inner edge 613, 623, 633, 643, and a radially outer edge 614, 624, 634, 644, respectively. Additionally, the blades 610, 620, 630, 640, also each possesses a top edge 615, 625, 635, 645, and a bottom edge 616, 626, 636, 646, respectively. For each of the blades, both the scraping face 611, 621, 631, 641, and the trailing face 612, 622, 632, 642, extend between the radially inner edge 613, 623, 633, 643, and the radially outer edge 614, 624, 634, and 644, respectively.

While the embodiments shown in FIGS. 13–16 show blades which are substantially symmetrical around the longitudinal axis L about which they rotate, it should be understood that alternative embodiments (for example, see FIGS. 17–18) are contemplated as within the scope of the invention wherein the blades are not symmetrical around longitudinal axis L. For example, with respect to FIG. 14, the radially inner edges 643 and 623 are located substantially along a first radius. It should be understood that the radially inner edges 623 and 643 could be located at different radii as in 723 and 713 in FIG. 18. Similar variations with respect to the radially outer edge are also contemplated as within the scope of the invention. It should also be understood that such variations in the radii at which the inner and outer edges are located are equally applicable to the narrow outer blades of FIG. 16 as well as the wide inner blades of FIG. 14. When descriptions of narrow and wide are used as above, they refer to the width of the forward face of each blade as defined between the radially inner edge and the radially outer edge. It should be further understood that while it is preferred that the inner blade have a larger width than that of the outer blade, it is contemplated as within the scope of the invention that the outer blade may also have a width greater than or equal to the width of the inner blade.

At least a portion of the outer blades 610, 630 and inner blades 620, 640 radially overlap each other within the fluid such that the fluid is kept compartmentalized and thus quiet for maximum efficiency. Since the outer blades 610, 630 are narrow, there is less surface area for solids to stick. The above described improved design of a scraper blade/stilling vane provides a substantial reduction in the torque required to scrape or clean the rotor. This permits the use of a smaller motor for the same size system, or alternatively, allows the same motor to drive the centrifuge at a higher rate of rotation. This design also assists in the removal of solids and prevents the solids from sticking to the scraper blade as well as allowing for better stilling effects to the fluid. The improved stilling effects minimize the turbulence generated in the fluid injected in the centrifuge. The minimization of turbulence means that less energy is necessary during the centrifuging process and thus is one source of the increased efficiency obtained from the reduction of torque required.

The advantages of the new scraper blade/stilling vane design may be obtained by having the radially outer edge 624, 644 of the first and second inner blades 620, 640 respectively located on a radius equal to that of the radially inner edges 613, 633 of the first and second outer blades 610, 630 respectively. It should be understood, however, that while improvement is obtained from an infinitesimal radial overlap, the preferred mode of operation entails some overlap as opposed to the miniscule amount that would result if the radially outer edge of the inner blades was on a radius equal to that of the radially inner edge of the outer blades. In a preferred mode, the radial overlap of the blades is at least 0.25 inches and in an even more preferred mode the radial overlap is 0.5 inches. It should be understood that, as always, in order to act as a centrifuge, the inner blades 620, 640 need to have a radially inner edge 623, 643 respectively which needs to extend radially inward past the lip of the mouth of the bowl.

Figure 17:
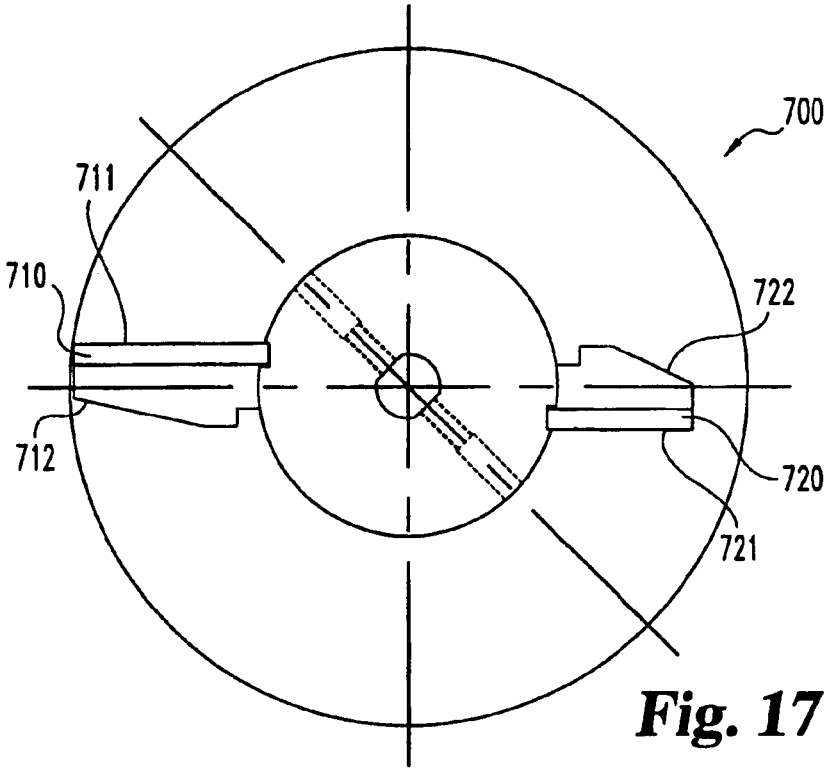
FIG. 17 is a top view of another embodiment of a scraping blade assembly having radially overlapping blades.
Figure 18:
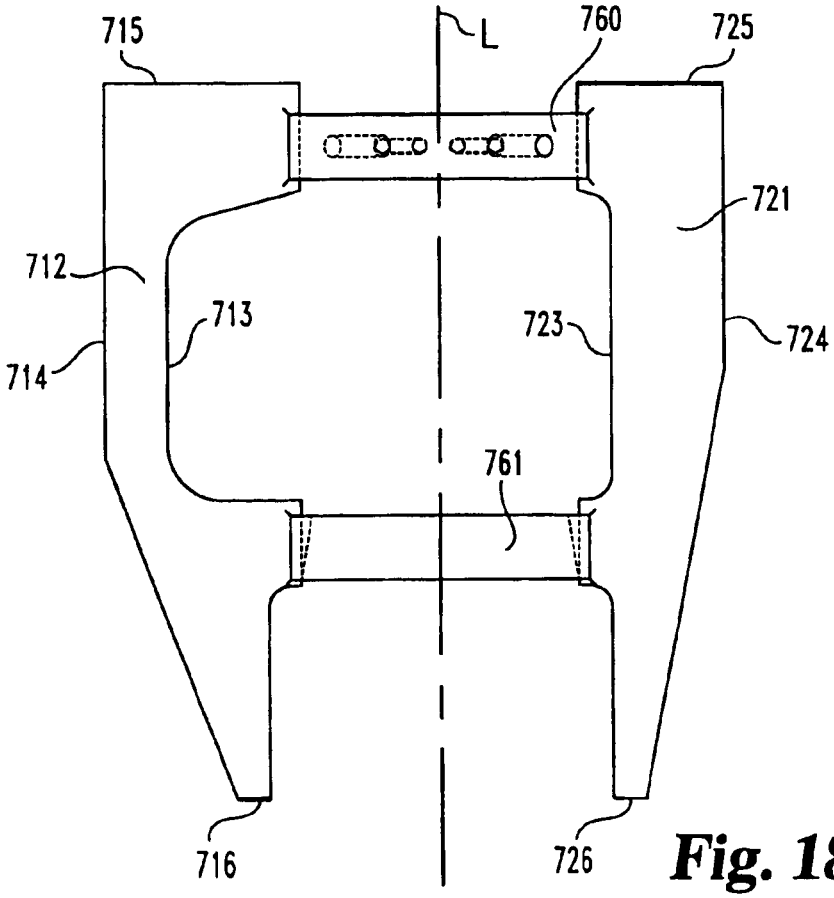
FIG. 18 is a side view of the embodiment shown in FIG. 17.

With reference to FIGS. 17 and 18, another embodiment of the present invention is illustrated in which the scraping blade assembly 700 has only two blades. An outer blade 710 and an inner blade 720 which are substantially aligned with one another and rotate around a longitudinal axis L. The outer blade 710 has a forward or scraping face 711, a rear or trailing face 712, a top edge 715 and a bottom edge 716. Similarly, the inner blade 720 has a forward or scraping face 721, a rear or trailing face 722, a top edge 725 and a bottom edge 726. The forward face 711 and rear face 712 of the outer blade 710 extend between the radially inner edge 713 and radially outer edge 714. Similarly, the forward face 721 and the rear face 722 of the rear blade 720 extend between the radially inner edge 723 and the radially outer edge 724. Again, the unique feature of the improved scraper blade/stilling vane design that allows for a substantial reduction in the torque required to scrape or clean the rotor is that the radially outer edge 724 is at a first radius and the radially inner edge 713 of the outer blade 710 is at a second radius. The first radius being at least equal to or greater than the second radius so that the outer blade 710 and inner blade 720 have at least some radial overlap.

It should be understood that while the embodiments of FIGS. 13–18 only depict blade assemblies having two or four blades, it is contemplated as within the scope of the invention that a different number of blades may be used. For example, three blades might he used with a radially inner blade, a radially outer blade and a middle blade. In this case the middle blade would have a radially outer edge substantially along a radius which was at least equal to or greater than the radius of the radially inner edge of the outer blade. Similarly, the radially inner edge of the middle blade would be at a radius less than or equal to the radially outer edge of the inner blade. In the same manner a plurality of blades numbering two or more may be constructed with varying patterns of radial overlap. All produce the same desired effect to some degree.

Again referring to FIGS. 13–16, another feature of the improved scraper blade/stilling vane design is that the blades are angled forward from the top edge 615, 625, 635, 645 to the bottom edge 616, 626, 636, 646 respectively in the scrape direction so that the blades 610, 620, 630, 640, force the solids down towards the bowl opening. This same angle is also beneficial in keeping solid particles from washing out prematurely while centrifuging and prior to scraping. The blades 610, 620, 630, 640 have an angle 617, 627, 637 and 647 respectively with respect to the longitudinal axis L about which the blades rotate. Angulation in the scrape direction may be accomplished through the blade design itself or through the use of inserts such as in the previously described embodiment of the present invention in FIGS. 8–9. It should be understood that a variety of angles ranging from zero to greater than five degrees will suffice to improve the operation of the centrifuge. While any angle is beneficial it has been found that angles of five degrees or greater provide a preferred mode of operation. It should be further understood that the angles 627 and 647, while shown as being equal, may be varied and need not be equal and that the same is true of the angles 617 and 637.

Thus the inserts for the blades as discussed previously with respect to the various embodiments of the invention depicted in FIGS. 8–9 may be used for purposes other than providing a customized cutting surface which may be varied as appropriate for different solid/liquid mixtures. As should be understood from the above description, the inserts may also provide varying forward angles as desired to direct the solids down toward the bowl opening in the case of an inverted centrifuge. It should be further understood that while the recesses of the blades shown in FIGS. 8–9 only extend part of the way between the radially inner and outer edges of each blade, it is contemplated as within the scope of the invention that the recesses, and correspondingly the inserts, may extend all the way between the radially inner and outer edges of each blade. Alternatively it is understood that the angles 617, 627, 637, and 647 may also be varied through the blade design as manufactured instead of through the use of inserts. It is further understood that some combination of blade design and the use of inserts may be utilized to achieve the desired angles.

It is also understood that the blades may instead be angled upward in the scrape direction as appropriate in other centrifuges where the fluid discharge exit is at the top of the bowl instead of the bottom. The use of angled blades is understood to be equally effective in top liquid discharging centrifuges. With prior systems the problem arose that when the discharge opening of a top discharging system clogged or plugged up, the fluid could potentially flow up into the bearing housing and damage the bearings and/or their housing. However, such potential for clogging is minimized with the centrifuge of the present invention.

The positive lock provided by the clutch mechanism of the above-described embodiments of the present invention permits more accurate control and measurement of various operating features of the centrifuge. For example, when injecting fluid into the rotor assembly, the accelerator or impeller 172 (see FIG. 3) and stilling vanes 170 bring the fluid up to the same speed as the rotor (the rotor being centrifuge bowl 185). This process of accelerating the fluid requires more horsepower or current than is required to keep the rotor at speed whether full of fluid or dry. The higher the fluid flow, the more horsepower required.

Since a drive (not shown) is used to control the motor 207 the feedback from the drive to a programmable logic controller (PLC) (not shown) may be used to control the operation of the centrifuge. As will be discussed in greater detail, measuring the feedback from a drive to the PLC in the form of such values as additional horsepower, current, % power, torque, or watts and then filtering it permits the centrifuge operator to determine the flow rate of fluid into the centrifuge. This is aided in part due to the fact that the positive lock clutch mechanism provides synchronous bowl and blade rotation so there is less noise and fluctuations in the centrifuge of the present invention which might otherwise lessen the accuracy of measurement and determination of the flow rate of fluid. It is understood, however, that the rate of fluid flow, flow control and detection of drive transmission failure and other system malfunctions is possible using the loop programmed into the PLC as described below, even when using clutch mechanisms other than the positive lock clutch mechanism of the present invention (but is less accurate and more prone to error).

The operation by which fluid flow into the centrifuge is determined will now be discussed in more detail as follows. The programmable logic controller includes a loop whereby after accelerating the rotor to speed the value of the load on the drive motor at that point is measured. The load on the drive motor may be measured by measuring the horsepower, current, % power, torque, or watts required to keep the rotor at speed. Using this measurement of load on the drive motor as a baseline, fluid is then injected into the centrifuge. A second value of the load on the drive motor under this new condition of fluid injection is then taken. The programmable logic controller then subtracts this new second value from the baseline value of load on the drive motor to obtain a third value that may be converted into the flow rate of fluid into the system. It should be understood that the order in which the loads on the drive motor (baseline and during fluid injection) are measured is irrelevant to the final determination of flow rate of fluid or other performance characteristics of the system. That is to say that the baseline value of load on the drive motor measured will be the same if measured after accelerating the rotor to speed and prior to injection of fluid, or if measured at some later time when injection of fluid is halted. As run time progresses, wear and tear on the centrifuge assembly occurs in such things as, for instance, the main bearings 150 and the scraper bearings 153. These bearings will initially loosen-up creating less drag. Toward the end of their life drag will increase. By using this loop, it is possible to tune the machine each process cycle, therefore eliminating bearing or drive fluctuations for accurate flow monitoring (or measurement of other performance characteristics of the centrifuge).

An additional feature using the monitoring loop or torque watch discussed above is the ability to determine whether there is drive transmission failure. By measuring the torque at speed as discussed above, when injecting fluid the programmable logic controller will check for an increase in horsepower, current, % power, torque or watts. If no increase is observed, the flow is shut off and the rotor is decelerated. It is understood that continuous monitoring and checking for the increase in the measured quantity is contemplated as within the scope of the invention. If the increase in the measured quantity is not present during the continuous monitoring at any time during processing the flow is shut of and the rotor is decelerated. The deceleration characteristics are then measured and depending on what they are, it is possible to determine whether a belt is broken or whether the flow/injection system is now functioning. Based on the results, it is possible to alert an operator of the centrifuge system to the exact nature of the problem. In addition, using the programmable logic controller to monitor the increase over the baseline value of load permits cut-off of the pump or valve controlling the flow to the centrifuge thereby eliminating the possibility of pumping out a tank in the case of a line break.

Another advantage of using a PLC to monitor the value of things such as horsepower, current, % power, torque, or watts is that measurement of the baseline number and comparison to the fluctuating number in the operating system permits the user to determine excessive vibration without the use of a conventional vibration sensor. When the rotor vibrates, the horsepower, current, % power, torque, or watts (whichever one is being measured) fluctuates. Using the PLC to monitor this value allows the user to stop a system and perform corrective action as necessary based on the drive information provided.

As mentioned above, the positive lock provided by the clutch mechanism of the above-described embodiments of the present invention also permits more accurate control of various operating features of the centrifuge. One additional benefit of this improved control is the use of the positive lock clutch mechanism for the purpose of removing solids from the blades. For example, when the normal scraping mode is complete there are still solids on the face(s) of each blade. Since the positive lock clutch mechanism provides the ability to rapidly rotate the blades in different directions (and, if so desired, to shift on the fly) the blades may be cleaned to some degree in a minimal amount of time immediately after a scraping mode is completed. The problem arises because the preferred mode of use by many end users of centrifuge systems is to only scrape out dry solids with no fluid in them. These dry solids are much more prone to stick to the surface(s) of the blade(s).

Thus, when scraping the bowl, the bulk of the solid cake exits the centrifuge by falling out under the influence of gravity. The remaining solids may be at least partially removed by using a variable frequency drive to quickly alternate the rotation direction of the blades back and forth to shake free any solid particles stuck to the surface(s) of the blade(s). Thus by implementing a "shake or shimmy" cleaning mode after the scraping mode is complete, the amount of solid particles stuck to the blade is minimized. In the preferred mode of operation the cleaning mode is used after each scraping mode. It should be understood, however, that this "shake or shimmy" mode need not be implemented after every scraping mode but may be used at predetermined intervals. It should be further understood that the use of the "shake or shimmy" mode may instead be determined by the PLC based on its calculations from the measured load. For instance, if the baseline value of load measured grows noticeably larger, the PLC could be programmed to recognize that as an indication that the blades are continuing to accrete a solid coating. When the increase reaches a particular level the PLC will activate the cleaning mode at the end of the next scraping mode. Similarly, the previously described method of using the PLC to detect excessive vibration could be used as a trigger for the cleaning mode since such vibration might result from an uneven distribution of accreted solids on the blade. The benefits of the cleaning mode are readily apparent to those of ordinary skill in the art. They include, but are not limited to, shortening the system down time and increasing the amount of time available for continued centrifuging of contaminated fluids.

While the invention has been illustrated and described in detail in the drawings and foregoing description, the same is to be considered illustrative and not restrictive in character, it being understood that only the preferred embodiment has been shown and described and that all changes and modifications that come within the spirit of the invention are desired to be protected.

What is claimed is:

1. A single motor centrifuge for separating contaminants from a fluid, comprising:

a first shaft configured to rotate about an axis, a bowl attached to the first shaft to rotate therewith, the bowl being configured to receive the fluic containing the contaminants;

a second shaft received through a passageway defined by the first shaft, the second shaft being configured to rotate about the same axis as the first shaft;

a plurality of scraper blades attached to the second shaft to rotate therewith, the scraper blades being received in the bowl to selectively remove the contaminants accreted on an interior surface of the bowl;

positive lock means for selectively coupling the first shaft and the second shaft to rotate the bowl and the blades in tandem at the same speed during a processing mode and to rotate the bowl alone in a scraping mode; and, a variable frequency drive electrically connected to the single motor, and wherein the single motor is rotatably connected to the first shaft.

2. The apparatus of claim 1, wherein all of the blades are angled to force the contaminants toward a discharge opening for the contaminants in the bowl.

3. The apparatus of claim 2, wherein the angle is greater than 5 degrees.

4. The centrifuge of claim 1, further including an accelerator, wherein the accelerator fastens the plurality of scraper blades on the second shaft, and a liquid injector below the bowl for injecting the fluid with contaminants upward, the fluid being injected upward during the processing mode, and the fluid impacts upon the accelerator which imparts a first rotational speed to the fluid about the same as the second rotational speed at which the plurality of scraper blades and the bowl are rotating.

5. The centrifuge of claim 1, wherein each of the scraper blades has a front face and an end, the end adjacent an interior wall of the bowl, the front face and the end defining a recess therein, the recess receiving a scraping insert, the scraping insert defining a cutting surface configured to plow solids accumulated on the interior wall of the bowl.

6. The centrifuge of claim 1, wherein the centrifuge is an inverted bowl automatic self-discharging centrifuge.

7. The apparatus of claim 1, wherein at least one of the blades has a forward angle from a top edge to a bottom edge, the forward angle being in a direction from a rear face to a front face.

8. The apparatus of claim 7, wherein the forward angle is created by at least one insert located in at least one recess in the blade.

9. The apparatus of claim 1, wherein the centrifuge has four scraper blades.

10. The apparatus of claim 1, wherein each blade has a width between a first radius and a second radius, and wherein a first portion of a first blade radially overlaps a second portion of a second of the plurality of blades but the radial overlap does not extend over the entire width of either the first or the second blade.

11. A single motor centrifuge for separating solids from a liquid, comprising:

a bowl attached to a spindle configured to rotate about an axis;

a plurality of scraper blades attached to a drive shaft, wherein the scraper blades are positioned to rotate in the bowl on the same axis as the spindle, and wherein the drive shaft is received in a passageway defined by the spindle; and, a variable frequency drive electrically connected to a single motor, the motor selectively rotatably connected to the spindle and the drive shaft by a positive lock means for selectively coupling the spindle and the drive shaft to rotate the bowl and the scraper blades in tandem at the same speed in a first mode and to rotate the bowl alone to produce relative motion between the bowl and the scraper blades in a second scraping mode.

12. The apparatus of claim 11, wherein all of the blades are angled to force the solids toward a discharge opening for the solids in the bowl.

13. The apparatus of claim 12, wherein the angle is greater than 5 degrees.

14. The centrifuge of claim 11, further including an accelerator, wherein the accelerator fastens the plurality of scraper blades on the drive shaft, and a liquid injector below the bowl for injecting the liquid with solids upward, the liquid being injected upward during the first mode, and the liquid impacts upon the accelerator which imparts a first rotational speed to the liquid about the same as the second rotational speed at which the plurality of scraper blades and the bowl are rotating.

15. The centrifuge of claim 11, wherein each of the scraper blades has a front face and an end, the end adjacent an interior wall of the bowl, the front face and the end defining a recess therein, the recess receiving a scraping insert, the scraping insert defining a cutting surface configured to plow solids accumulated on the interior wall of the bowl.

16. The centrifuge of clam 11, wherein the centrifuge is an inverted bowl automatic self-discharging centrifuge.

17. The apparatus of claim 11, wherein at least one of the blades has a forward angle from a top edge to a bottom edge, the forward angle being in a direction from a rear face to a front face.

18. The apparatus of claim 17, wherein the forward angle is created by at least one insert located in at least one recess in the blade.

19. The apparatus of claim 11, wherein the centrifuge has four scraper blades.

20. The apparatus of claim 11, wherein each blade has a width between a first radius and a second radius, and wherein a first portion of a first blade radially overlaps a second portion of a second of the plurality of blades but the radial overlap does not extend over the entire width of either the first or the second blade.

* * * * *